US012569709B2

(12) United States Patent
Parker et al.

(10) Patent No.: US 12,569,709 B2
(45) Date of Patent: Mar. 10, 2026

(54) DUAL MOTOR EXERCISE MACHINE

(71) Applicant: Tonal Systems, Inc., San Francisco, CA (US)

(72) Inventors: Colin Russell Parker, San Francisco, CA (US); Nihal Murthy, Oakland, CA (US); David Jonathan Zimmer, Exeter, CA (US); Michael Valente, San Francisco, CA (US); Reza Yazdani, San Francisco, CA (US); Thomas Kroman Watt, San Francisco, CA (US)

(73) Assignee: Tonal Systems, Inc., San Francisco, CA (US)

( * ) Notice: Subject to any disclaimer, the term of this patent is extended or adjusted under 35 U.S.C. 154(b) by 0 days.

(21) Appl. No.: 18/107,859

(22) Filed: Feb. 9, 2023

(65) Prior Publication Data

US 2023/0264062 A1 Aug. 24, 2023

Related U.S. Application Data

(60) Provisional application No. 63/308,656, filed on Feb. 10, 2022.

(51) Int. Cl.

| | |
|---|---|
| ***A63B 21/005*** | (2006.01) |
| ***A63B 21/00*** | (2006.01) |
| ***A63B 24/00*** | (2006.01) |

(52) U.S. Cl.

CPC ..... *A63B 21/0058* (2013.01); *A63B 21/153* (2013.01); *A63B 21/154* (2013.01); *A63B 24/0087* (2013.01); *A63B 2024/0093* (2013.01); *A63B 2225/02* (2013.01)

(58) Field of Classification Search

CPC ..... A63B 21/15–156

See application file for complete search history.

(56) References Cited

U.S. PATENT DOCUMENTS

| | | | | |
|---|---|---|---|---|
| 4,471,956 | A | 9/1984 | Marlo | |
| 4,968,028 | A | 11/1990 | Wehrell | |
| 4,998,721 | A | 3/1991 | Anders | |
| 6,120,423 | A * | 9/2000 | Mackey | A63B 21/153 482/121 |
| 6,280,361 | B1 | 8/2001 | Harvey | |
| 6,312,363 | B1 | 11/2001 | Watterson | |
| 6,482,139 | B1 | 11/2002 | Haag | |
| 7,163,488 | B2 | 1/2007 | Anders | |
| 7,278,958 | B2 | 10/2007 | Morgan | |

(Continued)

FOREIGN PATENT DOCUMENTS

| | | |
|---|---|---|
| EP | 3202465 | 8/2017 |
| KR | 101160960 | 6/2012 |

(Continued)

OTHER PUBLICATIONS

Spool Definition & Meaning, Dictionary.com, https://www.dictionary.com/browse/spool#google_vignette, 2024, 1 page.

*Primary Examiner* — Nyca T Nguyen

(74) *Attorney, Agent, or Firm* — Van Pelt, Yi & James LLP

(57) ABSTRACT

A strength training machine includes a first motor oriented at a first angle relative to a chassis. It further includes a second motor oriented at a second angle relative to the chassis. The first and second angles skew the motors with respect to each other.

16 Claims, 11 Drawing Sheets

(56) References Cited

U.S. PATENT DOCUMENTS

| | | | | |
|---|---|---|---|---|
| 7,568,650 | B2 | 8/2009 | Barker | |
| 7,717,824 | B2 | 5/2010 | Pinto | |
| 7,753,830 | B1 | 7/2010 | Marsh | |
| 7,909,742 | B2 | 3/2011 | Ish, III | |
| 8,029,425 | B2 | 10/2011 | Bronston | |
| 8,900,099 | B1 | 12/2014 | Boyette | |
| 9,101,791 | B2 | 8/2015 | Boyette | |
| 9,539,458 | B1 | 1/2017 | Ross | |
| 9,814,920 | B1 | 11/2017 | Monterrey | |
| 10,220,235 | B2 | 3/2019 | Norris | |
| 10,814,172 | B1 | 10/2020 | Ilfrey | |
| 11,007,398 | B2 | 5/2021 | Neuhaus | |
| 11,040,231 | B2 | 6/2021 | Rubin | |
| 11,130,022 | B1 | 9/2021 | Loduca | |
| 11,298,577 | B2 | 4/2022 | Watterson | |
| 11,478,676 | B2 | 10/2022 | Loduca | |
| 11,504,570 | B2 | 11/2022 | Neuhaus | |
| 11,541,264 | B1 | 1/2023 | Mallard | |
| 12,090,359 | B1 | 9/2024 | Gonzalez | |
| 12,285,649 | B2 | 4/2025 | Ye | |
| 12,311,214 | B2 | 5/2025 | Mooney | |
| 2004/0033866 | A1 | 2/2004 | Shapiro | |
| 2004/0242383 | A1 | 12/2004 | Karlstrom | |
| 2004/0254050 | A1 | 12/2004 | Morgan | |
| 2009/0029835 | A1 | 1/2009 | Ellis | |
| 2011/0275481 | A1 | 11/2011 | Greenhill | |
| 2012/0197168 | A1* | 8/2012 | Agrawal | A63B 21/4009 602/19 |
| 2013/0303334 | A1 | 11/2013 | Adhami | |
| 2013/0310230 | A1 | 11/2013 | Joshua | |
| 2014/0038777 | A1 | 2/2014 | Bird | |
| 2014/0073492 | A1 | 3/2014 | Hunter | |
| 2015/0335951 | A1 | 11/2015 | Eder | |
| 2016/0101322 | A1 | 4/2016 | Potter | |
| 2016/0332019 | A1* | 11/2016 | Rollins | A63B 23/129 |
| 2016/0346601 | A1 | 12/2016 | Marcandelli | |
| 2017/0027803 | A1* | 2/2017 | Agrawal | A61B 5/1122 |
| 2017/0035642 | A1* | 2/2017 | Sugata | A63B 21/4035 |
| 2017/0319941 | A1 | 11/2017 | Smith | |
| 2018/0021622 | A1 | 1/2018 | Holland | |
| 2018/0214729 | A1 | 8/2018 | Rubin | |
| 2018/0264306 | A1* | 9/2018 | Agrawal | A63B 24/0087 |
| 2018/0296879 | A1 | 10/2018 | Blium | |
| 2019/0046830 | A1* | 2/2019 | Chiavegato | A63B 24/0062 |
| 2019/0076691 | A1 | 3/2019 | Smith | |
| 2019/0083351 | A1* | 3/2019 | Suzuki | A61H 3/008 |
| 2019/0344115 | A1* | 11/2019 | Neuhaus | A63B 21/0058 |
| 2019/0344123 | A1 | 11/2019 | Rubin | |
| 2020/0047027 | A1 | 2/2020 | Ward | |
| 2020/0047030 | A1 | 2/2020 | Ward | |
| 2020/0047031 | A1 | 2/2020 | Orady | |
| 2020/0047053 | A1 | 2/2020 | Ward | |
| 2020/0047054 | A1 | 2/2020 | Ward | |
| 2020/0047055 | A1 | 2/2020 | Ward | |
| 2020/0054929 | A1 | 2/2020 | Ward | |
| 2020/0094096 | A1 | 3/2020 | Sorin | |
| 2020/0139186 | A1 | 5/2020 | Sorin | |
| 2020/0139187 | A1 | 5/2020 | Kennington | |
| 2020/0197741 | A1 | 6/2020 | Lee | |
| 2020/0222266 | A1* | 7/2020 | Gordon | A61H 3/008 |
| 2020/0254295 | A1 | 8/2020 | Watterson | |
| 2020/0332990 | A1 | 10/2020 | Bayerlein | |
| 2021/0111646 | A1 | 4/2021 | Rubin | |
| 2021/0128978 | A1 | 5/2021 | Gilstrom | |
| 2021/0236874 | A1 | 8/2021 | Ward | |
| 2021/0236876 | A1 | 8/2021 | Gregory | |
| 2021/0339078 | A1* | 11/2021 | Akeel | A63B 24/0087 |
| 2022/0062738 | A1* | 3/2022 | Neuhaus | A63B 71/0686 |
| 2022/0105378 | A1* | 4/2022 | Chiavegato | A63B 21/154 |
| 2022/0134171 | A1* | 5/2022 | LoDuca | A63B 21/063 482/99 |
| 2022/0184452 | A1 | 6/2022 | Valente | |
| 2022/0233907 | A1 | 7/2022 | Cobb | |
| 2022/0323815 | A1 | 10/2022 | Simental | |
| 2022/0370854 | A1* | 11/2022 | Zhang | A63B 21/169 |
| 2022/0409950 | A1* | 12/2022 | Zhu | A63B 22/02 |
| 2023/0009699 | A1 | 1/2023 | Ferlito | |
| 2023/0067732 | A1* | 3/2023 | Neuhaus | A63B 21/154 |
| 2023/0103725 | A1* | 4/2023 | Neuhaus | A63B 21/156 482/5 |
| 2023/0149778 | A1* | 5/2023 | Hendricks | A63B 24/0087 482/5 |
| 2023/0166952 | A1 | 6/2023 | Hall | |
| 2023/0201652 | A1* | 6/2023 | Ye | A63B 23/03541 482/133 |
| 2023/0241448 | A1* | 8/2023 | LoDuca | A63B 21/4035 482/99 |
| 2023/0405404 | A1* | 12/2023 | Belsham | A63B 21/4035 |
| 2024/0189651 | A1 | 6/2024 | Drayer | |
| 2025/0177800 | A1 | 6/2025 | Herring | |

FOREIGN PATENT DOCUMENTS

| | | |
|---|---|---|
| KR | 101482222 | 1/2015 |
| WO | 2014139336 | 9/2014 |
| WO | 2021151127 | 8/2021 |

* cited by examiner

DUAL MOTOR EXERCISE MACHINE

CROSS REFERENCE TO OTHER APPLICATIONS

This application claims priority to U.S. Provisional Patent Application No. 63/308,656 entitled DUAL MOTOR EXERCISE MACHINE filed Feb. 10, 2022 which is incorporated herein by reference for all purposes.

BACKGROUND OF THE INVENTION

Strength training, also referred to as resistance training or weight lifting, is an important part of any fitness routine. It promotes the building of muscle, the burning of fat, and improvement of a number of metabolic factors including insulin sensitivity and lipid levels. Many users seek a more efficient and safe method of strength training

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Described below are embodiments of dual motor implementations for exercise machines. In various embodiments, the embodiments of dual motor implementations described herein may be used with a machine where motor torque is associated with resistance, such as a digital strength trainer, further details of which will be described below. While embodiments of dual motor implementations are described herein for illustrative purposes, the techniques described herein may be variously adapted to accommodate any other type of multi-motor implementation (with any number of motors), as appropriate.

Digital Strength Trainer Overview

FIGS. 1A-1D illustrate embodiments of front perspective views of an exercise machine. In this example, the exercise machine has two arms.

Figure 1A:
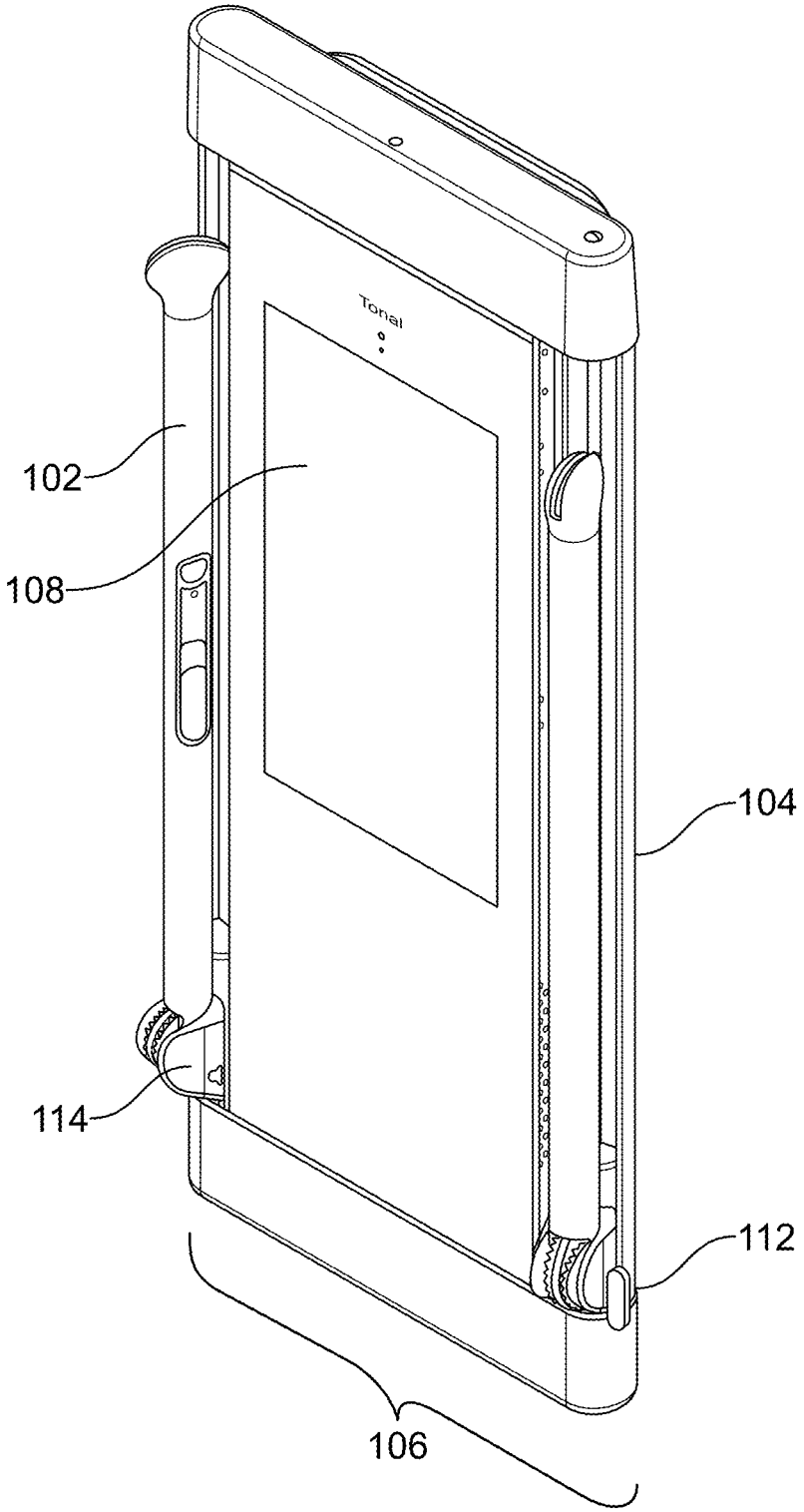
FIGS. 1A-1D illustrate embodiments of front perspective views of an exercise machine.

FIG. 1A illustrates an embodiment of a front perspective view of an exercise machine with the arms 102 and 104 in a stowed position, where the arms are upright.

Figure 1B:
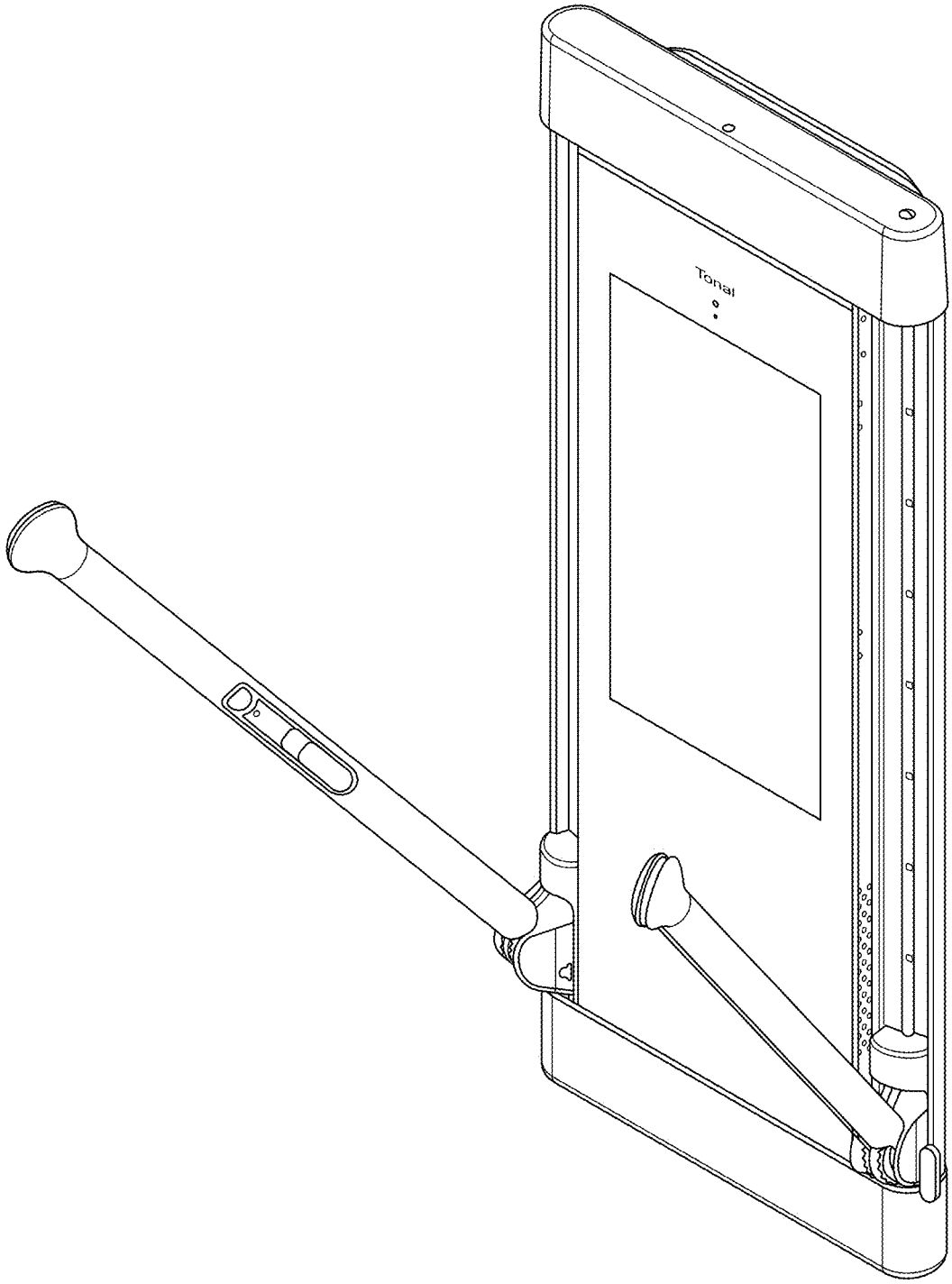

FIG. 1B illustrates an embodiment of a front perspective view of an exercise machine with the arms vertically pivoted outwards (angled away from the body of the exercise machine), pointing in an upwards direction.

Figure 1C:
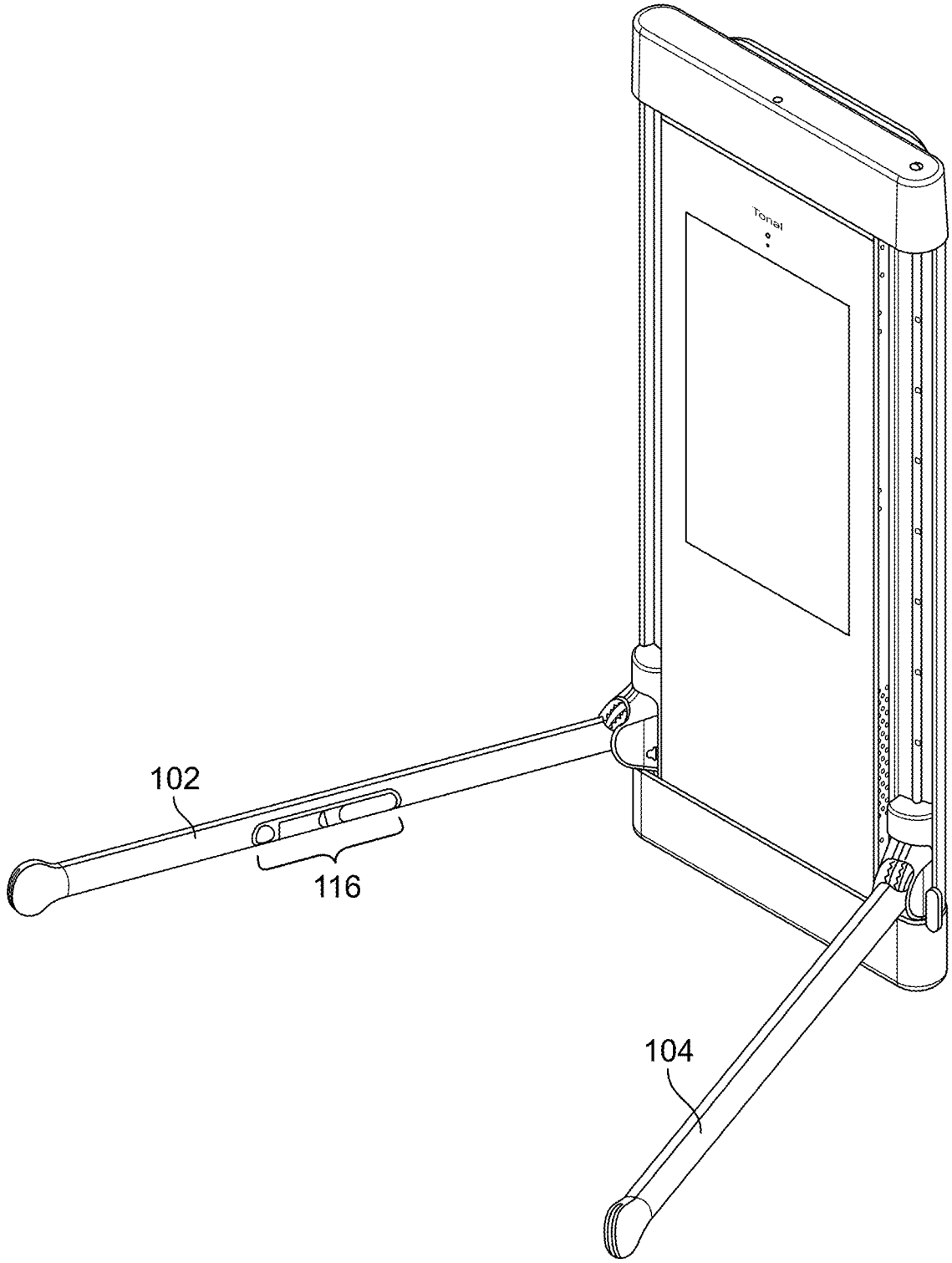

FIG. 1C illustrates an embodiment of a front perspective view of an exercise machine with the arms in mid-vertical pivot. In this example, control 116 includes controls for unlocking adjustment of arm 102. In some embodiments, arm 104 includes a corresponding set of controls.

Figure 1D:
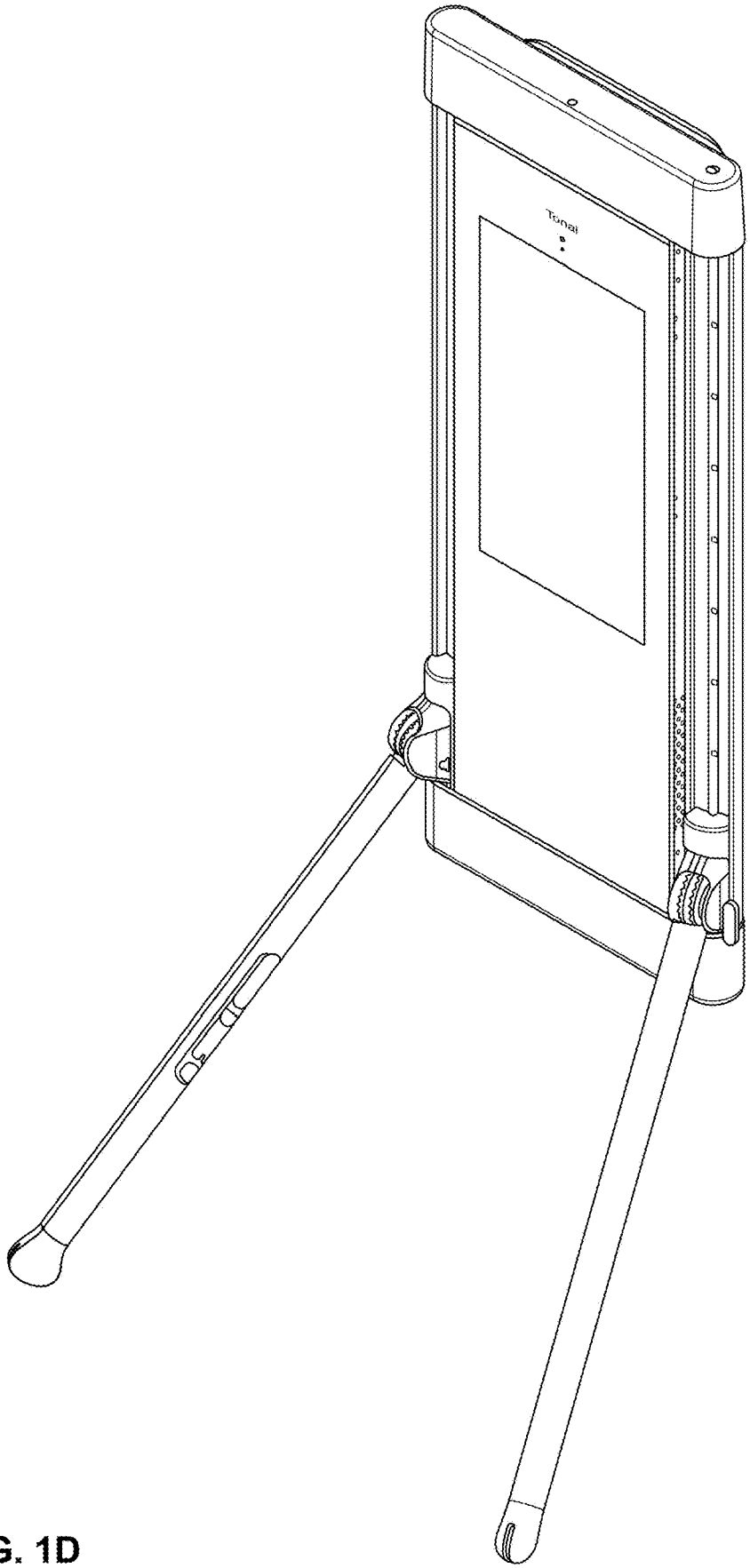

FIG. 1D illustrates an embodiment of a front perspective view of an exercise machine with the arms in mid-vertical pivot, pointing downwards.

While four angles of vertical pivot are shown in the examples of FIGS. 1A-1D for illustrative purposes, the arms may be independently pivoted to any angle as appropriate.

Further details regarding the exercise machine of FIGS. 1A-1D are described below.

In this example, the exercise machine of FIGS. 1A-1D is an embodiment of a digital strength trainer that uses two motors as load elements to provide electronic resistance.

In this example, cables travel within the arms, where one end of a cable in a given arm is coupled or otherwise connected to a motor (which may be in the body of the exercise machine). In some embodiments, at the distal end of an arm (away from the body/central console 106 of the trainer, as shown in FIG. 1A) is a handle attached to one end of the cable. A handle is but one example of an actuator that may be used by a user to perform exercise.

In some embodiments, the exercise machine is mounted to a wall. In other embodiments, the exercise machine is floor mounted. The exercise machine may also be a combination of wall/floor mounted. For example, the exercise machine may be mounted to the wall as well as bolted to the floor. The exercise machine may also stand on the floor while being wall mounted. In other embodiments, the exercise machine is freestanding. For example, the exercise machine is attached to a moveable stand, where the stand need not be hard mounted.

In some embodiments, the exercise machine includes an antenna, a camera (as well as other optical sensors, such as depth sensors, infrared sensors, etc.), a display, a touch screen, a touch screen controller, an audio input device (e.g., a microphone), an audio output device (e.g., a speaker), a motor controller, one or more electric motors, and actuators such as handles. An example of a screen is shown at 108 of FIG. 1A. The motor controller, the handles, and the electric motor are exemplary controllers, exercising components/actuators, and resistive devices/load elements, respectively. In this example, the exercise machine includes multiple motors (e.g., one per arm, where an embodiment of a two arm exercise machine such as that shown in FIGS. 1A-1D has two motors, an embodiment of a four arm exercise machine has four motors, etc.).

In some embodiments, the exercise machine includes a central console for controlling the exercise machine. In the example exercise machine shown in FIGS. 1A-1D, the exercise machine includes a display (e.g., display 108). In some embodiments, the display is a touch screen. In this example, the display allows instructional information (e.g., virtual training content) to be presented to the user and with which a user interacts. In some embodiments, to reduce the interference with an exercise routine that occurs whenever a user interacts with the exercise appliance/machine features or controls (e.g., because the user releases one of the handles in order to use the now free hand to modify settings selected from options indicated at the display, or moves physical controls located at the control panel, often proximate to the display), controls are incorporated in the handle. By suitable location of the user controls and application of control context information, the user is able to alter the exercise machine settings without undue pause.

While the example exercise machine shown here includes an embedded display, in other embodiments, the exercise machine does not have a display. In some embodiments, the exercise machine is connected to a television or touchscreen monitor via a connection such as HDMI, USB, displayport, etc. In some embodiments, images, audiovisual content, etc. are transmitted wirelessly to the external display device or other receiver devices (e.g., set top boxes, game consoles, etc.). Additionally, in some embodiments, data is sent to an application on a mobile device such as a tablet or smartphone, where the application then interprets and renders a user interface for interacting with the exercise machine, viewing exercise data measured by the exercise machine, etc.

The arms of the exercise machine may have various degrees of freedom (DOFs). In the examples of FIGS. 1A-1D, the arms of the exercise machine are each capable of moving in at least two directions: 1) horizontal pivot; and 2) vertical pivot (a rotation of the arm relative to the ground). As shown in the example of FIGS. 1A-1D, the arms pivot vertically about points 112 and 114, which are also referred to herein as the "shoulders" of the exercise machine. In some embodiments, the arms of the exercise machine are each capable of moving in a third direction: translation (sliding vertically up and down a track).

In other embodiments, the arms of the exercise machine each have two degrees of freedom: 1) vertical pivot) (also referred to herein as arm vertical pivoting in the "sagittal" plane); and 2) telescoping of the arm (e.g., retraction/collapsing of the arm and extension of the arm). In some embodiments, the arms of the exercise machine are angled outwards from the body (also referred to herein as the central console) of the machine. For example, the sides of the body/frame of the machine are not perpendicular, but rather are slanted outwards. In some embodiments, angled arms are used in lieu of having an additional degree of freedom (e.g., horizontal pivot of the arms). By having the arms on a pivot angle, when the arms pivot, they start (e.g., when pointed upward) in their most compact (least wide) configuration, and widen as they move downwards. This allows the distance between the arms to vary based on the pivot angle. The telescoping, along with the vertical pivot and angled out arms, allows for the arms to provide a large range of motion. The use of angled arms provides various benefits, for example, by simplifying the design of the arms and reducing complexity and cost (e.g., by removing the need to have mechanisms to allow the arms to pivot horizontally), but still retaining a similar amount of functionality (as would be provided by implementing horizontal pivoting of the arms).

Dual Motor Implementation Digital Strength Trainer

In some embodiments, the digital strength trainer described above utilizes two motors, where each arm is associated with a corresponding motor. The use of dual motors provides various benefits. For example, direct drive motors may be used, where each direct drive motor provides resistance for a corresponding arm. The use of direct drive motors allows users to work at a lower weight, as there is less friction and inertia in a system with direct drive motors (versus, for example, systems that involve the use of gearboxes, differentials, etc.). The use of dual motors also provides various hardware benefits, such as reduction in componentry such as pulleys, as will be described in further detail below. The reduction in pulleys further reduces friction in the system.

In some embodiments, the dual motors are individually controllable. For example, each motor is individually controllable such that a different resistance can be applied to the cables of the two arms. This individual controllability facilitates various types of exercises. As one example, partner workouts can be implemented, where two users can use the machine together, with one user exercising using one of the arms, and the other user exercising using the other arm. For example, the system allows different weights/resistances to be set on each motor. This in turn results in different cable tensions from the left side to the right side. This allows the two users to do the same exercise at different weights, or different exercises at the same time.

The use of one motor for each arm also allows for the ability to assess left and right performance. For example, a user's performance can be measured on each side. The separate left and right performance information may be used to determine imbalances in the user's strength. For example, the left and right sensor measurements may be used to determine if the user is failing on one side versus the other (e.g., struggling with one side versus the other) based on determining whether the velocity profiles of the two sides are matching.

Figure 2:
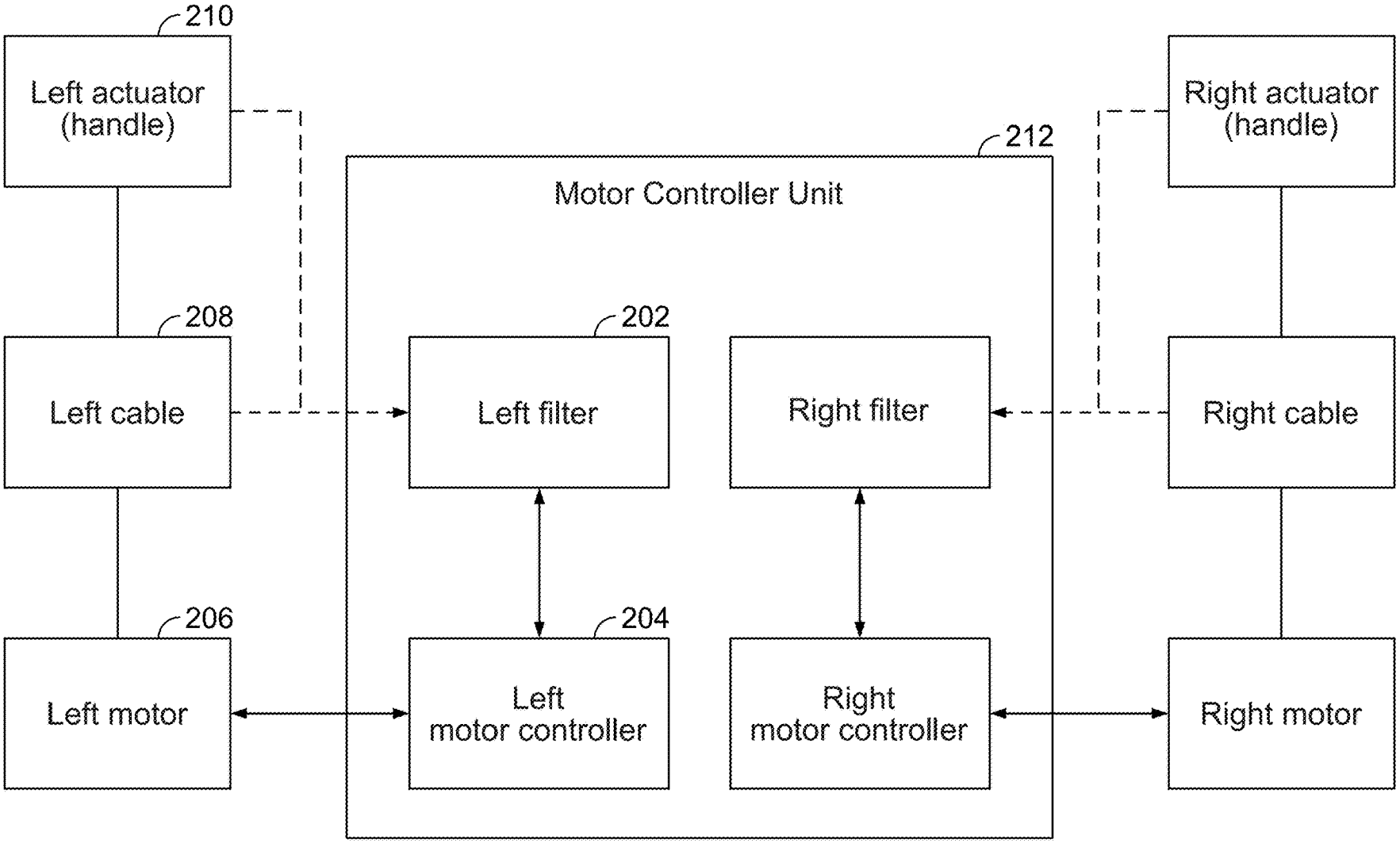
FIG. 2 illustrates an embodiment of an architecture of a dual motor exercise machine.

FIG. 2 illustrates an embodiment of an architecture of a dual motor exercise machine. The electronic motors of the dual motor exercise machine are used to generate tension/resistance. For example, an electromagnetic field is used to generate tension/resistance. In one embodiment, three-phase, permanent magnet synchronous motor (PMSM) motors are used to generate tension/resistance. Alternatively, other types of electrical motors may be used to generate tension/resistance, such as induction motors or other electrical systems.

Such a digital strength trainer using electricity to generate tension/resistance is also versatile by way of using dynamic resistance, such that tension/resistance may be changed nearly instantaneously. When tension is coupled to position of a user against their range of motion, the digital strength trainer may apply arbitrary applied tension curves, both in terms of position and in terms of phase of the movement: concentric, eccentric, and/or isometric. Furthermore, the shape of these curves may be changed continuously and/or in response to events; the tension may be controlled continuously as a function of a number of internal and external variables including position and phase, and the resulting applied tension curve may be pre-determined and/or adjusted continuously in real time.

In the example of FIG. 2, an embodiment of an architecture for controlling dual motors is described. For illustrative purposes, examples of controlling one side of the exercise machine (e.g., left side in the examples below) using the architecture shown in FIG. 2 is disclosed. Embodiments of the control techniques described herein are also applicable to the other side of the exercise machine. In this example of FIG. 2, the digital strength trainer includes the following:

- a controller circuit (204), which may include a processor, inverter, pulse-width-modulator (PWM), and/or a Variable Frequency Drive (VFD);
- a motor (206), for example a three-phase permanent magnet synchronous motor (PMSM) or induction AC motor, driven by the controller circuit;
- a spool with a cable (208) wrapped around the spool and coupled to the spool. On the other end of the cable an actuator/handle (210) is coupled in order for a user to grip and pull on. The spool is coupled to the motor (206) either directly or via a shaft/belt/chain/gear mechanism. Throughout this specification, a spool may be also referred to as a "hub";
- a filter (202), to digitally control the controller circuit (1004) based on receiving information from the cable (208) and/or actuator (210);
- one or more of the following sensors (not shown in FIG. 2):
  - a position encoder; a sensor to measure position of the actuator (210). Examples of position encoders include a hall effect shaft encoder, grey-code encoder on the motor/spool/cable (208), an accelerometer in the actuator/handle (210), optical sensors, position measurement sensors/methods built directly into the motor (206), and/or optical encoders. Other options that measure back-EMF (back electromagnetic force) from the motor (206) in order to calculate position also exist;
  - a motor power sensor; a sensor to measure voltage and/or current being consumed by the motor (206);
  - a user tension sensor; a torque/tension/strain sensor and/or gauge to measure how much tension/force is being applied to the actuator (210) by the user. In one embodiment, a tension sensor is built into the cable (208). Alternatively, a strain gauge is built into the motor mount holding the motor (206). As the user pulls on the actuator (210), this translates into strain on the motor mount which is measured using, for example, a strain gauge in a Wheatstone bridge configuration. In another embodiment, the cable (208) is guided through a pulley coupled to a load cell. In another embodiment, a belt coupling the motor (206) and cable spool or gearbox (208) is guided through a pulley coupled to a load cell. In another embodiment, the resistance generated by the motor (206) is characterized based on the voltage, current, or frequency input to the motor.

In one embodiment, a permanent magnet synchronous motor (PMSM) motor (206) is used with the following:

- a controller circuit (204) combined with filter (202) comprising:
  - a processor that runs software instructions;
  - three pulse width modulators (PWMs), each with two channels, modulated at 20 kHz;
  - six transistors in a Three-Phase Full-Bridge PWM Inverter configuration coupled to the three PWMs;
  - two or three ADCs (Analog to Digital Converters) used to measure the current s and voltages on the Three-Phase Full-Bridge PWM Inverter. The implementation can be two phase measurements or measurement of all three phases measurements;
  - optionally, ADC channels to measure other system sensors such as temperature;
- the permanent magnet synchronous motor (PMSM) (206), which may include an induction motor, such that:
  - the motor (206) may be in an "out-runner configuration", used throughout this specification when the shaft is fixed and the body of the motor rotates, such as that used by an electric bike hub motor;
  - the motor (206) may have a maximum torque output of at least 60 Nm and a maximum speed of at least 300 RPMs; These are example parameter values (e.g., based on machine weightlifting capacity), and may be different in other embodiments. For example, the parameters may be open and tuned for a machine's requirements. For example, if a 400 pound machine is desired, a ~120 Nm @ ~300 RPM would be needed in some cases.
  - optionally, with an encoder or other method to measure motor position;
- a cable (208) wrapped around the body of the motor (206) such that entire motor (206) rotates, so the body of the motor is being used as a cable spool in one case. Thus, the motor (206) is directly coupled to a cable (208) spool. In one embodiment, the motor (206) is coupled to a cable spool via a shaft, gearbox, belt, and/or chain, allowing the diameter of the motor (206) and the diameter of the spool to be independent, as well as introducing a stage to add a set-up or step-down ratio if desired.
- an actuator (210) such as a handle, a bar, a strap, or other accessory connected directly, indirectly, or via a connector such as a carabiner or ballstop to the cable (208).

In some embodiments, the controller circuit (202, 204) is programmed to drive the motor in a direction such that it draws the cable (208) towards the motor (206). The user pulls on the actuator (210) coupled to cable (208) against the direction of pull of the motor (206).

One purpose of this setup is to provide an experience to a user similar to using a traditional cable-based strength training machine, where the cable is attached to a weight stack being acted on by gravity. Rather than the user resisting the pull of gravity, they are instead resisting the pull of the motor (206).

Note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast in a digital strength trainer, there is no actual weight stack. The notion of the weight stack is one modeled by the system. The physical embodiment is an actuator (210) coupled to a cable (208) coupled to a motor (206). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (206) may be converted into linear force by multiplying it by radius r.

If the virtual/perceived "weight stack" is moving away from the ground, motor (206) rotates in one direction. If the "weight stack" is moving towards the ground, motor (206) is rotated in the opposite direction. Note that the motor (206) is pulling towards the cable (208) onto the spool. If the cable (208) is unspooling, it is because a user has overpowered the motor (206). Thus, note a distinction between the direction the motor (206) is pulling, and the direction the motor (206) is actually turning.

If the controller circuit (202, 204) is set to drive the motor (206) with a constant torque in the direction that spools the cable, corresponding to the same direction as a weight stack being pulled towards the ground, then this translates to a specific force/tension on the cable (208) and actuator (210). Referring to this force as "Target Tension", this force may be calculated as a function of torque multiplied by the radius of the spool that the cable (208) is wrapped around, accounting for any additional stages such as gear boxes or belts that may affect the relationship between cable tension and torque. If a user pulls on the actuator (210) with more force than the Target Tension, then that user overcomes the motor (206) and the cable (208) unspools moving towards that user, being the virtual equivalent of the weight stack rising. However, if that user applies less tension than the Target Tension, then the motor (206) overcomes the user and the cable (208) spools onto and move towards the motor (206), being the virtual equivalent of the weight stack returning.

Setting the controller circuit to drive the motor with constant torque is an example of a filter (202): Throughout this specification, the equations by which the controller circuit (204) is configured to drive the motor (1006) are collectively referred to as a "filter". A basic filter comprises position as a mandatory input of a filter, for example position of the actuator (210) and/or cable (208). One example of a basic filter is one that drives the motor (206) with constant torque. An analogy to a digital strength training filter is a digital camera filter such as a sepia filter, or Polaroid filter, which includes equations that govern how the digital information from a camera sensor are processed to produce an image. Sometimes digital camera filters mimic something from the analog world such as film, which include chemicals on plastic film that react to the exposure of light. Similarly, by way of digital control, a digital strength training filter may make the resulting system feel like a weight stack being acted on by gravity on planet Earth, a weight stack being acted on by gravity on the moon, a weight stack connected via a pulley system acted on by gravity on planet Earth, a spring, a pneumatic cylinder, or an entirely new experience.

The set of equations that describe the behavior of the motor (206) are its filter (202). This filter (202) ultimately affects how the system feels to a user, how it behaves to a user, and how it is controlled. A motor may be controlled in many ways: voltage, current, torque, speed, and other parameters. This is an important part of a filter (202), because the filter includes equations that define the relationship between the intended behavior of the motor (206) relative to how the motor (206) is controlled.

In some embodiments, the digital strength training control techniques described above apply to each arm or side of the exercise machine. In some embodiments, a single microcontroller unit (MCU) (e.g., motor controller unit 212) is configured to run the control loops for both motors in the same processor to avoid any communication latencies.

The following are further embodiments of dual motor implementation of a digital strength trainer.

Example Motor Configuration

The following are embodiments of a motor configuration for the motors of a dual motor exercise machine. In some embodiments, the motors are designed as permanent magnet synchronous motors that are in an out-drive configuration. In some embodiments, the motors are sized (e.g., volume and diameter of motor) and designed (e.g., pole pair count) to generate a desired torque with a certain speed (e.g., max inward speed and max stall torque). For example, the motors are appropriately sized to obtain desired amounts of torque out of the motor while also having a small size (e.g., with a small radius/diameter) to have the appropriate inertial feel and properties, while not requiring a gearbox in some embodiments.

In some embodiments, to provide resistance against a user, the motor is controlled to spool the cable inwards into the body of the exercise machine. The user resists the motor by attempting to pull the cable out of the arm, against the motor (which is pulling on the cable to spool it inwards). As the user pulls on the cable against the spooling action of the motor, this results in tension in the cable. To provide a natural user experience, the motor is designed and controlled for at least the two parameters/elements:

- Feel: The amount of tension in the cable. This may be determined as a function of acceleration or speed. For example, if a user pulls out quickly, with a high acceleration, the motor can be controlled to affect the amount of tension by increasing the torque beyond the nominal requested value.
- Smoothness: As the user pulls out the cable, the amount of variability in the amount of torque provided and/or the tension in the cable. As one example, smoothness is defined such that the smoother the experience, the less variability.

Together, the above two elements define how smooth the motor feels as the user extends the cables.

In some embodiments, the exercise machine emulates kinematics and dynamics of motion, such as emulating a fixed force plus an inertial body (e.g., rotating object).

Negating Cogging Torque

The sensation caused by cogging torque may be a challenge for low speed, high torque applications such as strength training, as the cogging torque may make strength training feel bumpy. In some embodiments, cogging torque and its effects are taken into consideration in the design of the motor itself (e.g., number of poles, magnet shape, etc. of the motors are determined based on cogging torque and its effects), as well as in the rest of the system. The choice of rope may also have an effect on this feel, where in some embodiments the type of rope/cable that is chosen is based on cogging torque and its effects. In some embodiments, the drivetrain is designed to reduce the effects of cogging torque.

Negating Torque Ripple

In some embodiments, the selection of motor geometry and architecture, combined with firmware control, are used to minimize or negate torque ripple. For example, the motor has a rotor and a stator. A torque sensor is placed in the motor. In some embodiments, as the motor is rotated, the system determines how the amount of torque that is generated varies as a function of mechanical position. In some embodiments, this mapping of torque perturbation is stored. In some embodiments, as the motor rotates, the mapping is replayed back onto the control signal that is used to request torque on the motor. This allows the system to perform wave cancellation, where the torque perturbations and cogging experiences can then be negated, providing a smoother feel to the user.

In some embodiments, the aforementioned cogging cancellation is performed for each motor separately. The cogging negation and torque ripple negation described above is beneficial in systems such as that described herein using direct drive motors, where there are not necessarily intermediary components such as gearboxes to damp the cogging sensation.

Inertia

The way in which use of the exercise machine feels to a user is based in part on the inertia of the system. For example, the motors will have an inertia based on their rotating mass, where the amount of inertia is a combination of where the mass is placed (e.g., along the motor's radius), the amount of mass at this point, etc. The feel of the system can be changed (e.g., to feel as if the user is lifting on the moon versus earth) by adjusting the amount of inertia in the system.

In some embodiments, the motor and system are designed to be low inertia. The use of direct drive motors, without the use of additional componentry such as gearboxes, reduces the amount of inertia in the system (as well as removing complexity). Having lower inertia allows an improved control scheme without having as much built-up inertia in the system. This allows the system to be more responsive and higher bandwidth.

In some embodiments, to adjust the feel of the system, inertia is dynamically added to the system. As one example, inertia is dynamically added in hardware by observing the behavior of the system and adding or reducing torque provided by the motors, introducing a haptic layer on top of the feel of the cables.

The following are further embodiments of dynamically changing inertia by applying a haptic feedback layer. In some embodiments, this includes changing the amount of torque being requested from the motor—that is, the amount of current that is put through the windings. Based on the acceleration measured from an encoder (which in some embodiments is embedded in a motor itself in order to be able to provide accurate rotor position without increasing mechanical complexity in an out-runner configuration), given a desire for the rotating body to have a net inertial force of a physical object plus an additional torque that the motor can apply from its stator and windings.

Using the dynamic inertia adjustment techniques described above, the system can be made to feel heavy by requesting a large torque that comes from the windings, or the system/resistance can be made to feel light by negating some of the inertia.

Temperature Compensation

The following are embodiments of temperature compensation in a dual motor exercise machine. In the dual motor exercise machine, if there are different loads on either motor, this will cause them to heat differently. The following are embodiments of compensating for temperature variations.

As a motor becomes hotter and hotter, a situation occurs where the magnets of the motors do not generate as much flux. There is thus an interplay between the permanent magnets becoming hot, the windings becoming hot, etc., where this interplay reduces the amount of flux and the amount of torque that can be achieved.

In some embodiments, temperature compensation is performed by fluctuating the current to a motor by changing or modifying the duty cycle of how often the power is on (e.g., at 20,000 times per second or any other frequency, as appropriate, either applying or not applying the voltage to control the amount of current being produced). In some embodiments, the gates of a PWM (pulse-width modulator) used to control the motor are ratiometrically adjusted. The proportion of the window that a PWM (pulse-width modulation) gate is on can be scaled in order to generate the appropriate voltage across each of the winding phases. That is, the duty cycle is adjusted as a function of temperature. In some embodiments, this is done for each motor, independently, as each motor can be at a different temperature (e.g., due to different usage of the motors by the user, or different airflow, cooling, etc.). In some embodiments, the individual motors are compensated separately.

The following are further embodiments of temperature compensation. As one example, in firmware, the temperature of the stator is read, because the resistance in the coils changes as the temperature changes. Control values are dynamically changed to correct for that resistance change.

For example, each of the motors has a resistance. The amount of voltage to apply across the resistance in order to obtain a fixed current will be different. That is, for example, PWM gates used to control the motor will have to be open and on for a longer amount of time in order to generate the same amount of current that goes through the windings, in order to be able to generate the desired amount of flux. In some embodiments, a PI (proportional-integral) controller is used to determine how long to keep the switching transistor elements (e.g., MOSFETs, IGBTs, etc.) in the three-phase inverter bridge on or off and an amount of control signal to apply in order to obtain the desired current. If the resistance value were not updated, then a smaller window would be asked for.

The following are further examples of thermal compensation. In some embodiments, the resistance of the motor is determined as a function of temperature. In some embodiments, the resistance is modeled as a function of temperature. For example, the resistance of the stator is known at a baseline temperature (e.g., due to testing at the time of production). A look up table that maps resistivity based on temperature is queried in order to determine how resistance changes based on temperature. The resistance of the stator is updated based on the lookup. The motor control loop uses this information to determine how much current to put in the D and Q axis of the motor, where, in some embodiments, inductance and resistance are used as two drivers in order to determine those D and Q axis terms.

That is, in some embodiments, the resistance is updated, which changes the I (current) term (e.g., scales it) across a thermal range in order to ensure that the appropriate bandwidth and response is able to be achieved, irrespective of the temperature that the system is currently running at (e.g., 20 C or 90 C).

As another example of performing temperature compensation, resistivity of the stator wire (e.g., based on material resistivity, such as resistivity of copper) is determined. The motor temperature is measured. A resistance scalar is determined based on the measured temperature and the query of the lookup table. As one example, suppose that the baseline default resistance for the stator wire is known for a temperature such as 20 C. The default 20 C resistance is multiplied by the resistance scalar determined based on the lookup to determine an adjusted resistance given the measured temperature. In some embodiments, a function is executed that periodically uses the updated resistance to determine an integral gain value ($K_i$). The motor control loops then operate using the updated $K_i$ value.

Power Optimization

The following are embodiments of power optimization to maximize efficiency of the system. In some embodiments, the system is designed to draw power from a wall outlet to which the exercise machine is plugged into. Once the wall AC (alternating current) power is taken in, it is converted to DC (direct current) power.

In some embodiments, the AC-to-DC power supply is sized to provide the appropriate average amount of power and the appropriate peak power based on motor sizing, inverter sizing, and how users are using the device. In some embodiments, the sizing is determined based on a system design and optimization loop on both the power supply, the MCB (motor controller board to control the motors), and the shunt sizing along with the motor, where they are congruently sized based on average power and peak power. In some embodiments, the peak power is limited to the amount of current from the wall circuit (e.g., 15 A) multiplied by the derating (which may be required by UL or other agencies), and efficiencies of each series component (e.g., power supply and the inverter). In some embodiments, the inverter splits the received power to two separate bridges to drive the two separate motors. In some embodiments, two sets of inverter bridges and current/voltage sensors are used to drive the electric motors.

In some embodiments, the peak versus average power drain of the two motors in a dual motor implementation is taken into account for sizing the power supply. In some embodiments, capacitors/storage are utilized for handling peak power. In some embodiments, the type of capacitor/storage utilized takes into account that peak power is typically not maintained for a long period in the case of exercise. In some embodiments, torque is reduced during those very short peaks (where users may even prefer the feel). In some embodiments, the two motors' peak power generation is taken into account for shunting off the generated power fast enough to protect any electronics.

In some embodiments, the design of the motor is also optimized for power. As one example, an appropriate winding is determined to obtain the needed amount of torque that the motor should provide, with the appropriate amount of resistive losses, while having the appropriate amount of speed. This may also relate to the balancing act between inertia and motor sizing as well. That is, there is a tradeoff/balance of being able to move fast enough, but generate sufficient torque, but also prevent creating too much heat and resistive losses in the motor such that it is unable to move fast enough or generate sufficient torque.

In some embodiments, power may be fed from one motor back into the other motor, rather than using a shunt. For example, the user's power is used to feed the other motor, analogous to regenerative braking.

In some embodiments, the system includes shunts. In some embodiments, one motor can be driving and the other one generating (e.g., push pull movement)—one example implementation is to duplicate components including power supplies and shunt circuits. In some embodiments, the motors are run off of a single DC bus, where the dual motor setup is implemented such that the shunting does not dissipate excess power when the other motor is to be driven. In some embodiments, the system is power balanced when excess energy is absorbed.

In some embodiments, in order to minimize power losses and improve efficiency, such as in the inverter, the system also runs at a relatively higher voltage. By increasing the voltage, the amount of current is reduced through the windings. This reduces $I^2R$ (current squared multiplied by resistance) power losses, allowing power to be used more effectively.

Power Throttling

There are limitations to the amount of power that can be drawn from the electrical supply (e.g., from the wall outlet that the exercise machine is plugged into). For example, suppose a limit of 1500 W that can be drawn from a home outlet. In some embodiments, when used by the exercise machine, the power is de-rated down, and then split between the two motors.

The power drawn from the outlet is consumed or used by the motors in at least the following two ways:

- Mechanical Power—the motor converts some portion of the electrical power to provide torque at a certain speed—this mechanical power can be determined by multiplying force by velocity.
- Power losses ($I^2R$) losses due to internal resistance of the motor. This is the loss that is incurred in order for the system to generate the desired torque. Such losses remain the same regardless of the velocity of the motor.

The total power consumed by the motor can be determined as the sum of the power losses in the motor and the mechanical power generated and provided by the motor.

As described above, there is a ceiling on the amount of power that is available from the outlet that the exercise machine is plugged into (e.g., 1500 W). This power must be split between the two motors. If a user requests one of the motors to provide a large amount of digital weight, and the user is moving quickly, such that the motor will have to pull inwards quickly, then it is possible that the one motor will use up all of the available power on its own. This could cause a breaker to trip in a person's home, or cause the power supply of the system to brown out.

In some embodiments, to avoid issues such as a circuit breaker tripping or power supply brownouts, dynamic power throttling is performed by the exercise machine (e.g., a microcontroller or processor configured to control the motors of the exercise machine).

In some embodiments, performing power throttling includes determining an exercise machine operating power envelope or ceiling. As one example, the system is designed to work on a standard 15 A breaker in a home in North America (other types of power standards in other regions may also be utilized, with power optimization techniques described herein adapted to accommodate such different standards). Derating is performed to determine the envelope. For example, 75% derating is applied (other derating values may be used, as appropriate). The envelope may be determined by the voltage (e.g., 115V)*current (15 A)*derating (e.g., 75%), resulting in an approximately 1300 W limit.

The amount of power being used by the motor (which is converted into mechanical power (generated torque at a certain speed) and power losses) is dynamically determined. This includes dynamically determining, for a motor, power losses (e.g., due to resistance) and the generated mechanical power (torque times velocity). For example, the estimated power losses are added to the estimated mechanical power generated to determine the total amount of power consumed by the motor. This power consumed by the motor(s) is then used to determine how close the power consumption of the system is to the allowed power envelope.

The following are embodiments of dynamically determining or estimating the amount of drawn power consumed due to losses. In some embodiments, the resistance of the stator is determined. For example, the nominal resistance of the stator at a certain angle is known. The current measured temperature of the stator is determined. As described above with respect to thermal compensation, the resistance of the stator wire as a function of the measured temperature is determined. For example, the resistance of the motor is not necessarily directly determined, but is dynamically inferred or estimated from a baseline resistance. For example, the resistance of a motor may be determined before it is placed in the exercise machine unit. This is used as a baseline or starting point for dynamically determining the resistance of the motor. A table is implemented from which the resistance is dynamically determined. For example, the table indicates a change in resistance for various temperatures, thereby modeling the variation in resistance versus temperature. A lookup is performed of this table that relates stator wire resistivity as a function of temperature. The deviation in resistance obtained from the lookup is then applied to the baseline resistance to dynamically determine the resistance of the stator wire given the current temperature measured. The amount of current passing through the windings of the motor is also determined. Based on the dynamically determined resistance of the stator wire, and the current passing through the stator wire, the $I^2R$ losses for each motor are computed.

The following are embodiments of determining the amount of mechanical power being generated by the motor. In some embodiments, the mechanical power is determined based on the amount of power requested from the motor, as well as the speed of the motor.

The mechanical power and the lost electrical power are summed in order to determine how much power a motor is drawing from the wall outlet. This is determined for both motors, and the total power consumed by motors is then summed together.

If, for either of the motors (or in aggregate), the sum of the power consumed exceeds a threshold voltage, or is within a threshold deviation from the ceiling (e.g., close to the maximum limit or determined envelope), then the system determines that either of the motors (or together in aggregate) are operating close to the power ceiling, and the amount of torque that the motors (one or both) are being requested to provide is reduced.

In some embodiments, as part of determining whether to throttle (or reduce) power consumption by reducing the amount of torque requested, the system considers other contextual information related to the exercise being performed.

One example of contextual information is the type of movement being performed. For example, the system determines whether the movement being performed is a single-sided movement or a double-sided movement. If a one-sided movement is being performed, then the motor being used is throttled. If a dual-sided movement is being performed, then, in some embodiments, the power throttling is applied evenly to both motors. For example, each side is given the same power-draw ceiling. (e.g., 750 W maximum or 650 W maximum (derated) for each arm). As another example, if the movement is known to be one-sided, and it is determined that the other side is not being used, then the power ceiling for the individual motor being used can be raised. That is, the power ceiling may be dynamically determined and adjusted for each motor based on the exercise being performed. Based on the dynamically determined power envelope for a single motor (or across both motors), if the power consumed is at or exceeds the threshold (or is within a threshold deviation from the power envelope), the amount of force on the cable (provided by the motor) is reduced (e.g., by reducing torque requested from the motor) to ensure that the motor's power draw ceiling is not exceeded.

As another example, with two motors, partner workouts may be facilitated, where each user is using one of the arms (and thus one of the motors). In this context, for power throttling, the motors may be reduced individually or together (e.g., at the same rate or ratiometrically). The power throttling may also be based on the current amount of force and/or speed of the motors. For example, suppose that one of the motors is providing 25 pounds of resistance, while the other motor is providing 75 pounds of resistance (because the two users are performing different exercises, or the same exercise at different requested weights). The power throttling may be applied to the motor that is providing more digital weight resistance. Or the power throttling may be applied to the motor that is moving faster, even if it is the lower weight, as the product of force and velocity (power) may be higher.

As described above, in some embodiments, power throttling is performed by actively controlling the torque that the motor is putting out. Speed is unable to be directly controlled, as it is based on the user's motion and interaction. However, by controlling torque, this has a downstream collective impact on controlling the speed.

While the above embodiments are described in the context of a dual motor system, they may also be applied to systems with other numbers of motors, such as a single motor system, or a system with three or more motors.

Orientation of Motors within the Body of the Dual Motor Exercise Machine

The following are embodiments regarding installation, mounting, and placement of motors within the body of a dual motor strength trainer.

Staggering of Dual Motors

Figure 3:
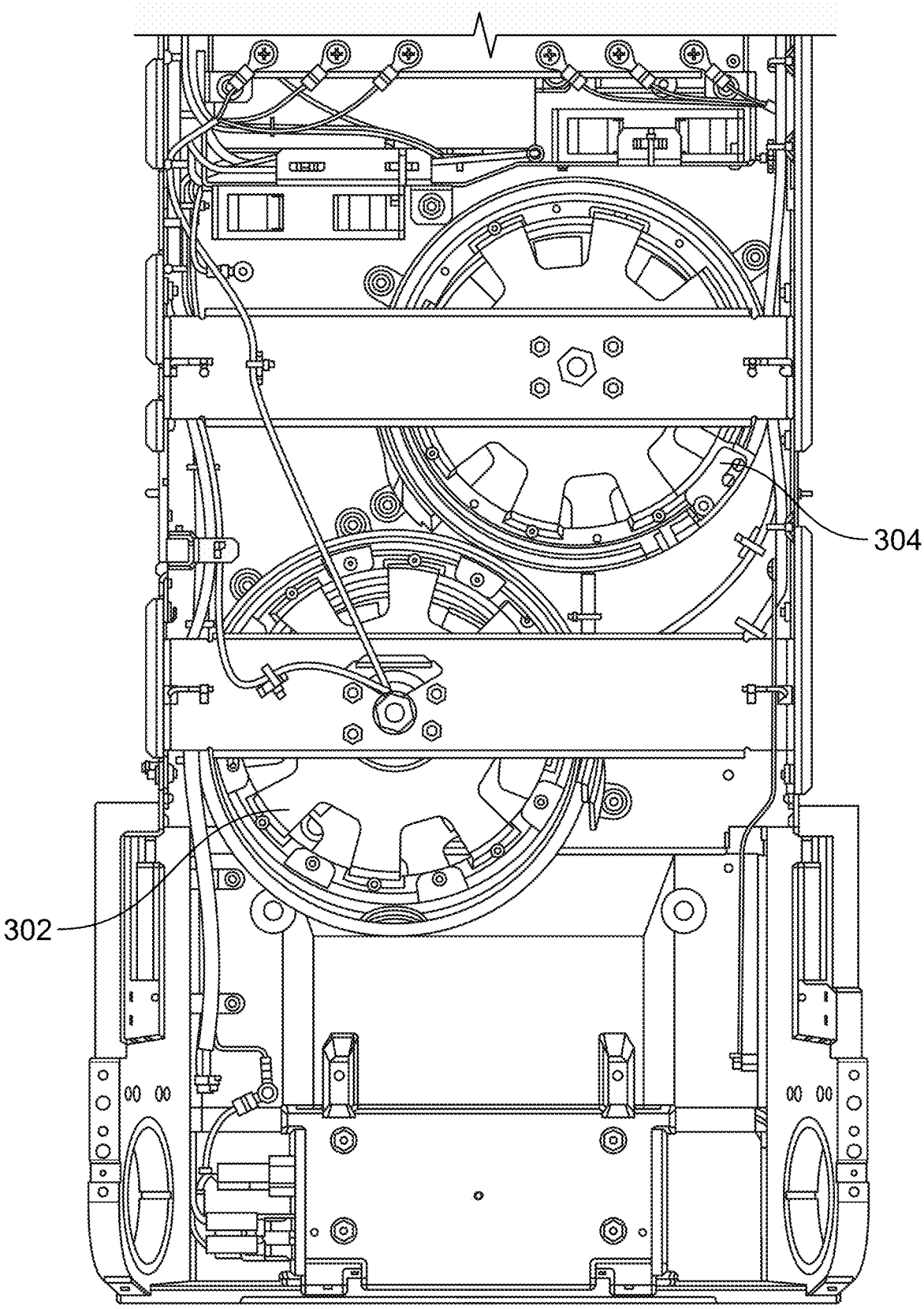
FIG. 3 illustrates an embodiment of dual motors in a chassis of a dual motor exercise machine.

FIG. 3 illustrates an embodiment of dual motors in a chassis of a dual motor exercise machine. As shown in this example, the motors 302 and 304 are oriented vertically, with one motor above the other. The motors 302 and 304 are also staggered. The staggered vertical stacking of the motors provides various benefits. For example, the volume utilized by the two motors is minimized, as compared to having them next to each other horizontally. This allows the body of the exercise machine to be more compact. The staggered orientation also allows the ropes/cables coming off of the motors to be appropriately routed without conflicting with each other.

The following are embodiments of securing or mounting the motors to the chassis to improve repairability, serviceability, and also manufacturability. In some embodiments, the chassis and motor are designed such that a motor slips into a recess, and a long-threaded shaft is dropped down through the center of the motor shaft to provide clamping. This allows single-sided access, without having to secure the shaft from both sides.

Skewing/Tilting of Dual Motors

Figure 4:
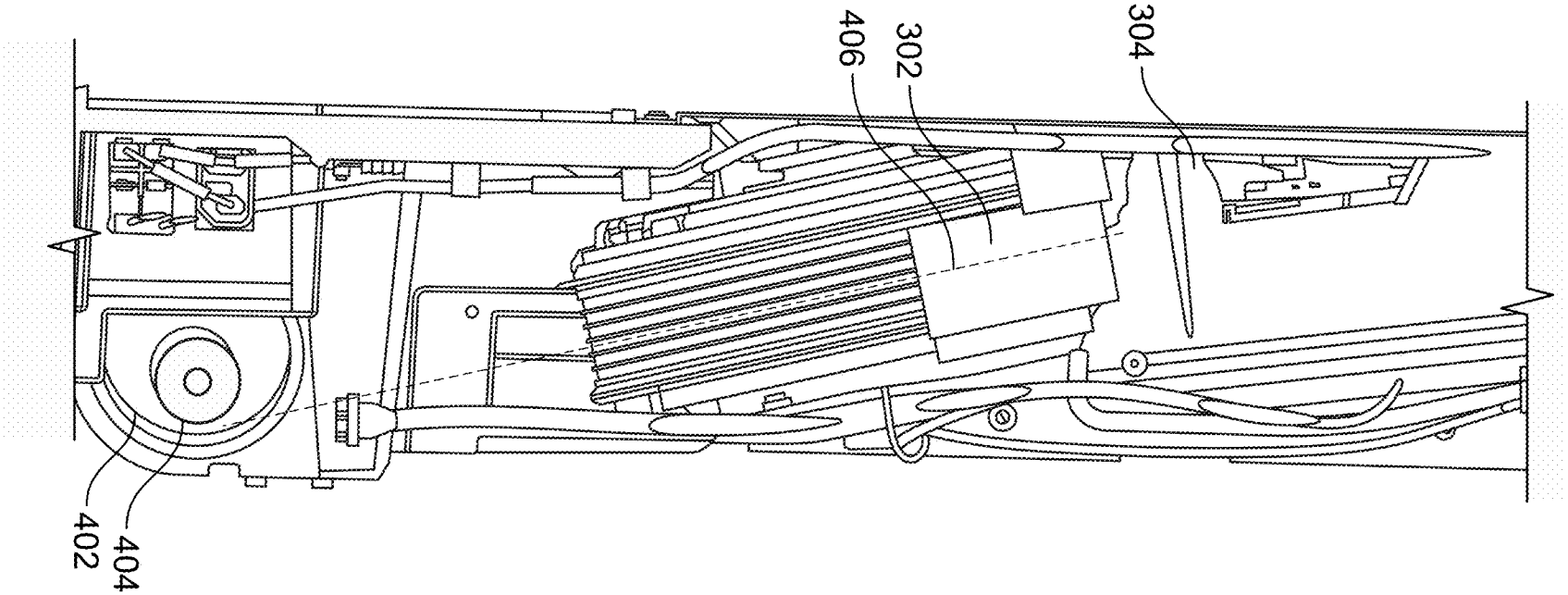
FIG. 4 illustrates an embodiment of the mounting of motors in the chassis of the exercise machine.

FIG. 4 illustrates an embodiment of mounting of the motors in the chassis of the exercise machine. In this example, a side profile view of the internal structure or chassis of the exercise machine shown in FIG. 3 is shown. As shown in this example, the motors are tilted towards the back of the exercise machine (where the back of the exercise machine in this example is the side of the exercise machine that would be against a wall if the exercise machine were wall mounted). In some embodiments, the motors are tilted to achieve a certain range of fleet angle of the cable. For example, the tilting of the motors affects the distance from where the rope or cable comes off of a spool/motor, down to pulleys at the shoulder areas (e.g., shoulder area 402) of the exercise machine. Taking motor 302 as an example, the cable on the spool of the motor exits through opening 402. In this example, because motor 302 is tilted, the cable will come off the spool/motor at an angle that is inline with shoulder 402. In this way, only a single pulley 404 is needed at shoulder 402 to guide the cable out of the shoulder (and to the arm attached to the shoulder). For example, if motor 302 were not tilted (and the cable came off the spool downward), then an additional pulley would be needed to turn and guide the rope to the pulley at the shoulder (e.g., a vertically oriented pulley at the bottom of the machine to turn or route the cable so that it can be directed to a horizontally oriented pulley at shoulder 402 that allows the cable to be directed out of the shoulder). By having the motors tilted, a single tilted pulley (that effectively combines the two aforementioned pulleys) can be used to allow the cable to exit the body of the exercise machine. In this way, the angle of the motor is inline with the pulley that directs the cable out of the body of the exercise machine.

In some embodiments, the motors may also be tilted side-to-side to facilitate the cable routing angles into, for example, angled shoulders (in some embodiments of a digital trainer, the shoulders of the exercise machine are angled to avoid a third degree of freedom for arm width adjustment).

Fleet Angle

As described above, the tilting of the motor allows the fleet angle of the cable to be within an acceptable range as it spools or unspools off of the motor. As one example, suppose a center line of the sheave 406 of the drum of the motor 302. The angle at which the rope comes off of the center line of the sheave is the fleet angle. In some embodiments, for different ropes and cables, there is a minimum angle that is not to be exceeded (to prevent issues with how well the rope spools on the drum).

Figure 5A:
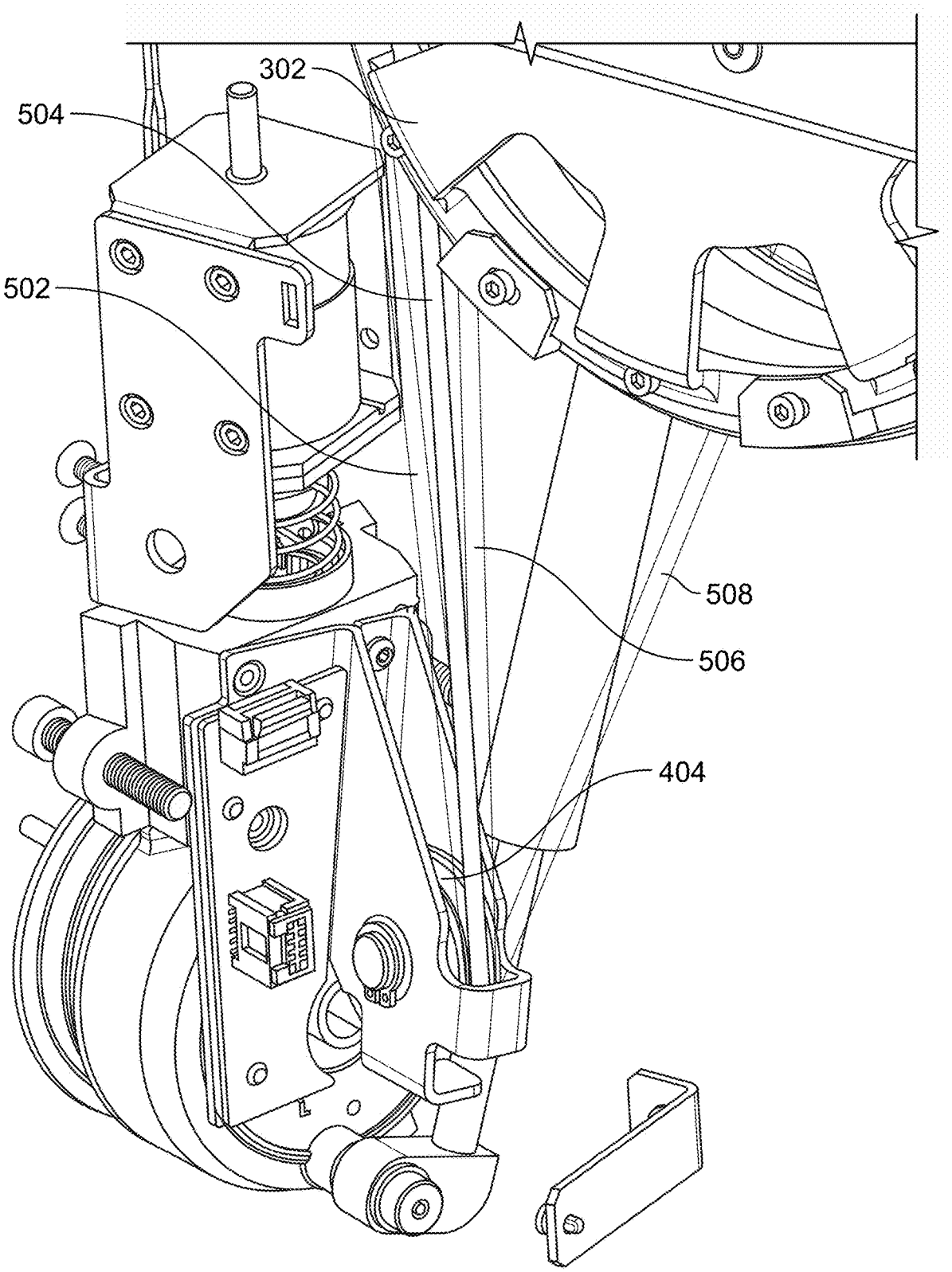
FIG. 5A illustrates an embodiment of fleet angles of a cable.

FIG. 5A illustrates an embodiment of fleet angles of a cable. Shown in this example are motor 302 and pulley 404. As shown in this example, the angle at which pulley 404 comes out of the vertical axis of the body of the exercise machine provides the desired rope guidance. As shown in this example, both the pulley and the motor are tilted toward the back of the exercise machine (where, if the exercise machine is wall-mounted, the back of the exercise machine is the side of the machine that is against the wall). This tilting of the shoulder exit pulley and coordinated tilting of the motor allows the rope or cable to come off of the spool/drum at fleet angles that are within a desired range of fleet angles.

Shown at 502, 504, 506, and 508 are illustrations or instances of the cable coming off the spool at different points of the spool. As shown in these examples, the cable comes off the spool at various fleet angles.

Figure 5B:
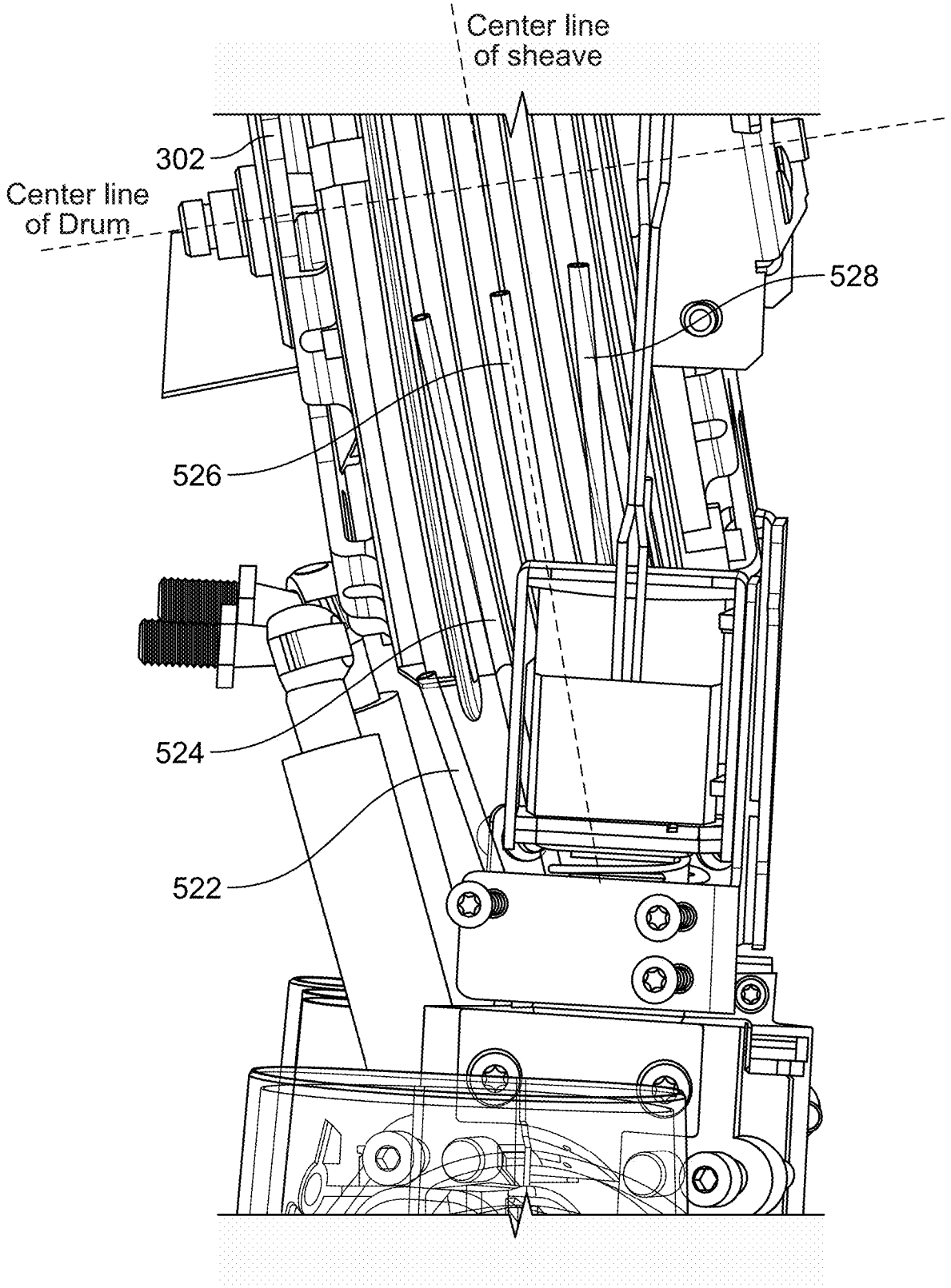
FIG. 5B illustrates an embodiment of fleet angles of a cable.

FIG. 5B illustrates an embodiment of fleet angles of a cable. In this example, a side profile view of motor 302 is shown. The angle of the rope is shown at various points (522, 524, 526, and 528) throughout its spooling. As shown in this example, as the rope spools or unspools, the fleet angle of the cable changes.

In this example, when the cable is in the middle point of the spool at 526, the cable is at the center line of the sheave (with fleet angle of 0 degrees). At 524 is the point of spooling that illustrates the angle of the cable when the rope is near to being fully unspooled. At 522 is shown the angle of the cable when fully unspooled, and the rope/cable is hanging off of a knot where the rope is tied off to the structural portion of the motor. At 528 is shown the angle of the cable when fully spooled (e.g., the handles are retracted fully). As shown in this example, the fleet angle of the rope varies along the full sweep of the motor.

In this example, there is a single layer of cable wrapping across the depth of the drum. Having a single layer (where the cable does not wrap over itself on the spool during spooling), prevents issues such as rope click, jerking, and uncertain changes in diameter (mechanical advantage) that would occur when the cable wraps over itself.

Additionally, as there is only a single layer, there is thus a constant radius that is being operated on compared to the cable. If there were a second layer of wrap, this would increase the radius in the movement arm, where the amount of tension in the cable would change from the first wrap to the second wrap. In this case, there is a constant radius for the cross sections of the rope laying on a single constant layer. In some embodiments, the motor drum includes grooves to facilitate spooling.

As shown above, by angling the motor (as well as the pulley at the shoulder of the body of the exercise machine), the amount of fleet angle between where the cable meets the spool is reduced, allowing improved lining up of the cable.

Staggered Orientation and Fleet Angle

The staggered orientation of the dual motors in the body or frame of the exercise machine as shown in the examples of FIG. 3 and FIG. 4 has an effect on fleet angle. This is due to one of the motors being further from its shoulder than the other motor is to its corresponding shoulder.

Figure 5C:
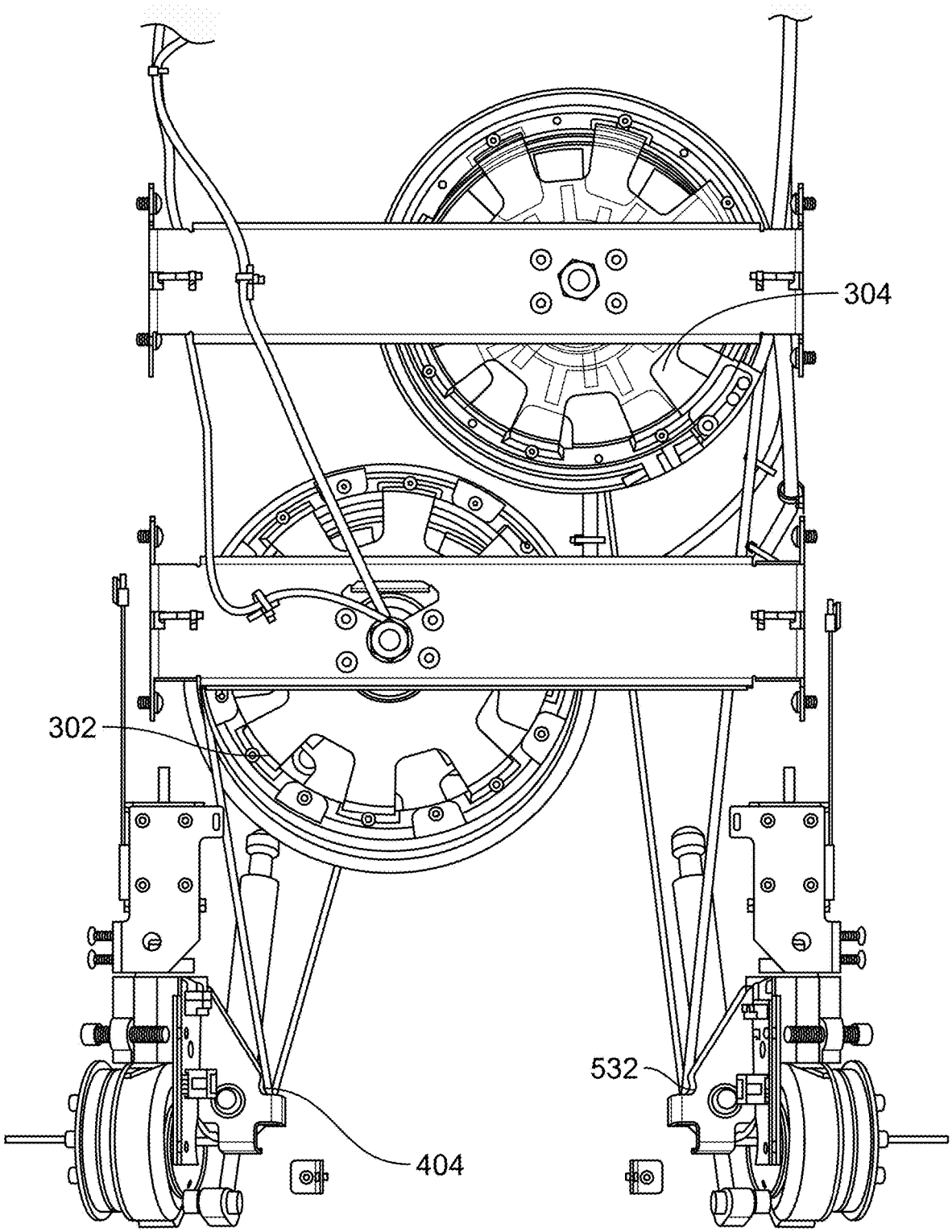
FIG. 5C illustrates an embodiment of a staggered dual motor orientation and fleet angles.

FIG. 5C illustrates an embodiment of a staggered dual motor orientation and fleet angles. Because motor 302 is closer to its corresponding pulley 404 than motor 304 is to its corresponding pulley 532, motor 302 has a much wider fleet angle (as compared to the fleet angle range for motor 304) as it traverses the width of its drum.

Figure 5D:
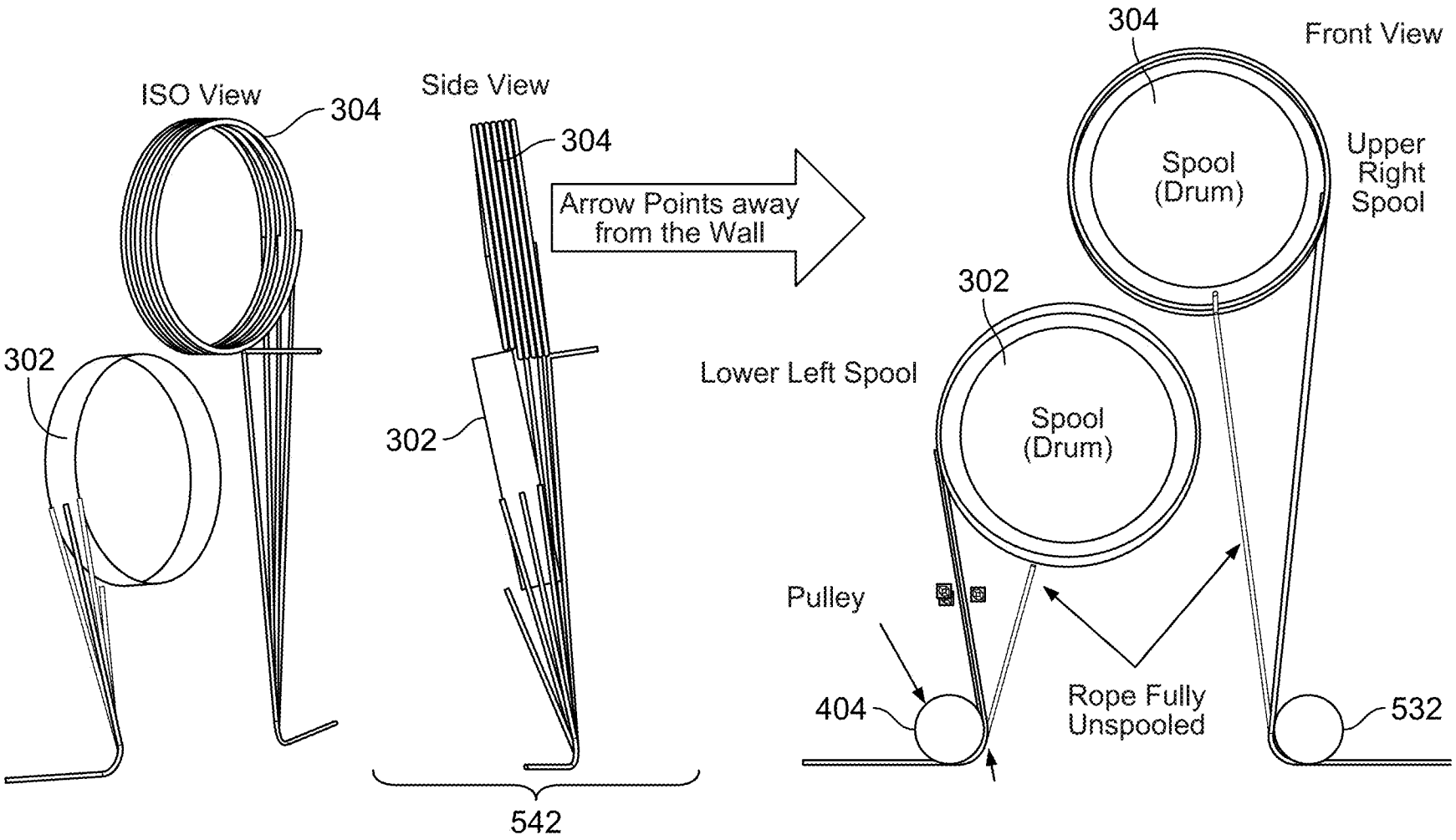
FIG. 5D illustrates an embodiment of fleet angles.

FIG. 5D illustrates an embodiment of fleet angles. In this example, an ISO view, side view, and front view of the staggered dual motor orientation are shown. As shown in the side view 542, the cable on motor 302 (the spools of the motors are shown in this example) will go through a much wider range of fleet angles than the cable on motor 304 will go through. For example, the cable on motor 302 may experience fleet angles of [~±4° ], while the cable on upper right motor 304 may experience fleet angles of [~±2° ].

The wider range of fleet ranges may cause cable routing issues for the closer motor (302). For example, because the motor 302 is close to where the rope hits the pulley and comes off, that fleet angle is much larger, which can impact whether the cable is properly spooling (even with the grooves described above). This is less of a problem for the higher motor 304 because of the greater distance to its corresponding pulley (resulting in a smaller range of fleet angles). In some embodiments, to address such issues, the lower motor 302 is tilted at a different angle than the upper motor 304 is tilted. That is, the motor 302 and the motor 304 are skewed relative to (and with respect to) each other (and are not parallel to each other). In this way, the motor 302 is compensated for the desired fleet angle being exceeded. For example, motor 302 is tilted more than motor 304 to account for the wider range of fleet angles that will be experienced by the cable on motor 302.

Repetition Detection in the Context of a Dual Motor Exercise Machine

Various types of processing, such as spotting of the user, may be dependent in part on what phase of an exercise repetition that a user is in. This can be challenging in the context of dual motors, because the two motors on the different sides of the arms may be behaving differently, making it difficult to discern whether a user is in the concentric phase or the eccentric phase. For example, the user's arm motions may not be synchronized on the left and right, and if the left data stream and right data stream were evaluated independently, they may yield different results or determinations as to where the user is in one phase or the other. For example, independent evaluation of the data streams may indicate that the user is at the end of a rep on one arm, but not on the other arm. In some embodiments, the repetition and phase detection may be determined based on the state of the motors, as well as position updates. As there are two motors, there are two data streams, and it can be challenging to determine how to evaluate the two data streams together in a cohesive manner.

For example, suppose that one arm is starting the next repetition, but the other arm is still on the previous repetition, resulting in the user becoming out of phase. In such a case, it can be difficult for the system to determine where the user is in their exercise (e.g., concentric or eccentric phase), which can in turn impact determining whether a user should or should not be spotted at a given point.

The following are embodiments of performing repetition detection, as well as repetition phase detection. For example, the techniques described herein may be used to determine whether a user is in the concentric phase, eccentric phase, holding at the top or bottom of the repetition, etc. in a system utilizing multiple motors.

In some embodiments, the two data sets from the two motors are aggregated together and treated as one. A repetition detection algorithm is then run on the aggregated data set. One example of aggregation is adding the left and right cable positions together.

Repetition detection logic is then used on that singular, aggregated data set. In some embodiments, for a user performing the exercise with the exercise machine, during this motion, the cable may move through a range of motion which corresponds to a range of motion for the cables, spools, and motors of the system. In some embodiments, changes in cable position may correspond to changes in the readings of various sensors and in the physical position of various actuators such as linear electro-magnetic-mechanical, pneumatic, and so forth. This range of motion is termed "percent range of motion", which ranges from 0% to 100%, with the convention that 0% represents the beginning of the range of motion when the elbow is fully extended, and 100% represents the end of the range of motion when the elbow if fully bent. Both actual and ideal range of motion is considered. Actual range of motion is that a current user enacts, and ideal range of motion is that which a user should enact for an ideal or intended exercise.

In some embodiments, the first time a user performs a given movement/exercise, a start position, an end position, and stride length, the end position minus the start position, may be recorded. The end position may be the point at which the direction of movement changes from the direction corresponding to the weight stack moving away from the ground to the direction corresponding to the weight stack moving towards the ground. The start position may be the point at which the direction of movement changes from the direction corresponding to the weight stack moving towards the ground to the direction corresponding to the weight stack moving away from the ground. In one embodiment, calibration and/or adjustment may be based on recordings from each movement in a set. Alternatively, calibration and/or adjustment may be based on recordings over multiple sets, such that the results over time are combined and stored for use in future sets.

In some embodiments, the start points and end points may be updated with each repetition, or an average, moving average, or weighted average of the last plurality of recorded samples are used, and may include samples from previous sets.

In some embodiments, range of motion and repetitions are extracted from a series of aggregated position updates. Hysteresis is used to filter out small movements that may be mistaken for a new repetition, such as when a user is struggling, and this learns over time by averaging the position of the start and end of the range of motion. Averaging may also occur over weighted averages and/or moving averages.

The concentric phase of an exercise is reflected when range of motion is increasing, for example 0% to 100%, and the eccentric phase of an exercise is reflected when range of motion is decreasing, for example from 100% to 0%. The bounds of 0% and 100% need not be actually reached as the user may be lazy or exceeding their average. When range of motion changes from increasing to decreasing, or decreasing to increase, is sufficient to determine a transition from concentric to eccentric or eccentric to concentric.

In some embodiments, the repetition and phase decision logic is implemented in firmware, and is run on the aggregated data stream. The following is an example of aggregation. In some embodiments, the distance of travel for the left arm is added the distance of travel for the right arm. If both arms can be extended out to the same maximum cable distance of travel, then the maximum distance of travel is double the maximum distance of travel of one of the arms.

In some embodiments, the distance of travel has a directionality, depending on whether the cable is being extended out of the arm, or is retracting back into the arm. For example, if one arm is traveling outwards, and the other is traveling inwards by the same amount, this will result in an aggregate value of zero travel that is occurring.

By combining the travel distance values into a single aggregate value that is operated on, the system avoids a situation where the state machine determines different repetition phases for the different arms, and is unable to determine a single repetition phase that the user is in. Rather, there is one source of truth that is a combination of the position information from both the left and right sides of the exercise machine.

As shown in the above examples, in some embodiments, the position updates from the two arms are combined into a single aggregate position value. The repetition detection logic described above then operates on this aggregate value (rather than evaluating the left and right data streams separately).

Spotter Functionality in the Context of a Dual Motor Exercise Machine

In some embodiments, spotting is performed if a user is struggling while in the concentric phase of a repetition, which is when the user is causing the cable to be extended outwards.

As one example, suppose that a user is performing a bench press. Suppose that the user is struggling on the right side, but not on the left. In some embodiments, the motors of both arms are lowered together to the same level of resistance (to the lower digital weight level). In some embodiments, the system treats the two motors as two separate entities, where spotting can be implemented on the motors separately. As one example, the system spots the right side that the user is struggling on (e.g., by reducing the amount of resistance being provided by the system to the user's motion), while keeping the left side the same amount of weight. In this example, the resistance provided by the motor on the left side remains high, and the level of weight provided by the motor on the right side is lowered, allowing the user to finish the repetition.

As described above, spotting is performed when the user is struggling during a concentric phase of a repetition. The following are embodiments of spotting by using the repetition detection described above to determine whether a user is in a concentric phase of a repetition by extracting repetition state information from position updates in the context of an exercise machine with dual motors. For example, left and right cable position values are determined. The left and right position values are added together to determine an aggregate position value.

A repetition detection algorithm such as that described above is run to determine various parameters, such as minima, maxima, phase changes, direction changes, etc. These parameters are determined according to the aggregate position update value. These values are then used to determine whether the user is in a concentric phase, an eccentric phase, holding at the top of the repetition (where the top is the point at which the user is transitioning from concentric to eccentric), holding at the bottom of the repetition (where the bottom is the point at which the user is transitioning from eccentric to concentric), or holding in the middle of a repetition.

After determining and tagging the user as being in the concentric phase of the repetition, the spotting algorithm is notified that the user is in the concentric phase. If the user is determined to be in the concentric phase for a threshold amount or period of time (which may be an indication that the user is struggling), then the spotter algorithm decreases the amount of weight that they are applying to one or both of the motors to assist the user (which may be based, for example, on context such as the type of movement being performed (e.g., one-sided or two-sided), whether a partner workout is being performed, etc.).

Tilting to Bail in the Context of Dual Motors

One example of an exercise that utilizes both arms is a bench press exercise. In some embodiments, a user is able to quit the exercise (and cause the weight provided by the motor to be reduced) by performing a tilting motion, where the user retracts one side more than the other side (and/or extends one side more than the other), where this deviation is monitored for by the system and is used as an indication that the user would like to quit the exercise. In some embodiments, to perform a bench press, the user may also use a bar accessory that attaches to the two arms.

A bar tilt mode such as that described above may be easier to use with a differential because a user can perform push-pull without any resistance. However with a dual motor implementation, there may be resistance to the tilt—thus, this mode may not be as effective as a way of quitting an overly heavy lift. In some embodiments, an intelligent spotting algorithm is configured to step in faster and more aggressively in the bottom range of motion (so, for example, a break should not be taken with the bar resting on a user's chest). This may be particularly critical on the first rep in case the user has the weight set too high for themselves. As another example, a 'stand your ground algorithm' may be used in the first rep when the weight comes on for an exercise such as bench press, and similarly, in some embodiments, if the user starts moving before the weight is fully ramped up, the digital strength trainer may stop ramping the weight at that point, or in some embodiments, start ramping it down as the user moves inward.

As described above, with two motors, it may be more difficult for the user to generate the deviation in positions of the two sides. In some embodiments, a threshold deviation is used that accounts for this increased difficulty by the user to create a difference in position between the two arms. In some embodiments, the threshold deviation is also dynamically determined, and is also a function of where the handles are relative to the ends of the arms (e.g., how far they are retracted or extended).

In some embodiments, the handles are attached to corresponding ball stops. The ball stops are connected to the cables that pass through the arms of the digital strength trainer. When the handle is fully retracted, the ball stop will come up against the wrist of the arm.

In some embodiments, the system (e.g., via a motor controller board (MCB) and/or processor monitoring cable position and motor measurements) checks to determine whether either ballstop is within a minimum distance of a wrist (e.g., less than 3 inches away, or any other minimum distance, as appropriate).

If either ballstop is within the minimum distance from the wrist, the system reduces the threshold deviation between the two sides to trigger bailing due to tilting of the bar. As it becomes more difficult for the user to generate a delta between the two sides the closer the cables are to the ball stops, reducing the total threshold deviation (that triggers bar bailing) allows the system to become more sensitive to deltas created by the user. The difference between the left cable position and the right cable position is then computed to determine whether the deviation is greater than a threshold deviation. If so, then the system determines that the user is indicating that they would like to quit the exercise, and performs actions such as removing the digital weight.

In this example, when the user becomes close to the ball stop, the threshold deviation changes. In some embodiments, once one cable becomes closer to the ball stop, the total threshold deviation between the two sides needed to trigger bailing (reducing resistance) is reduced or lowered—this makes the system more sensitive to detecting tilt to bail (e.g., smaller delta between left and right sides will trigger reducing of digital resistance) if one of the cables is closer to the ballstop.

Controlling for Slack Events

The following are embodiments of controlling for slack events. When the user moves outward faster than the motor can keep up, the motor may either keep constant torque and just let the user overpower and thus generate slack, or an algorithm controlling the motor may increase resistance to slow the user (such as an isokinetic mode). In some cases, if the user goes faster and then stops suddenly, the motor may overshoot as tension drops to zero. Now the user may experience a jerk when the motor catches up and starts retracting—in some embodiments, managing this jerk is also an effect of how fast the sensing is and how fast the control system can react.

For example, when a person performs an explosive movement, pulling the cable outwards, this motion may actually cause the rope to stand up and off of the motor drum itself. In some embodiments, the system includes a spool guard. In some embodiments, the spool guard is used to contain any slack. In another embodiment, a secondary roller (e.g., over the drum or where the cable comes off the drum) is included that keeps the cable in place.

The following are further embodiments for controlling slack. Examples of techniques for controlling slack using firmware or software are described. A motor such as those described herein involves a rotating mass. In some embodiments, controlling for slack involves accurate determination of rotor position, inertia, and physics of the system to bring the rotating bodies of the motor to a stop quickly without slack spooling. If slack events to occur, they are arrested into a small space. In some embodiments, a rope tension sensor may be used to react quickly (where a direct torque sensor on the motor shaft and using the BEMF (back electromotive force) on the motor itself may take longer to sense the tension change due to the inertia of the motor). A similar case may occur when the user tries to move inward faster than the motor's maximum speed. In some embodiments, the trainer is configured to distinguish high dynamic speed movements from a user dropping the handle.

The following are further embodiments of controlling for slack events.

Once the motor spins outwards (e.g., because the user pulls on a cable), due to inertia of the rotating mass of the motor, the motor will continue to spin unless another force brings it to a stop.

For example, suppose that a user is performing a chop movement (example of an explosive movement). This causes the motor to accelerate outwards. Even though the user will abruptly stop their motion, because the motor has inertia, it will continue to spin on its own, causing slack of the cable to be generated within the exercise machine, as well as some additional slack that comes outside of the arm.

The following are embodiments of detecting and controlling such slack events. In some embodiments, the determination of whether a slack event had occurred and whether the user has stopped pulling on the cable is determined by evaluating the acceleration of the motor itself using the internally embedded encoder.

In the example chop movement described above (or any high power moves with high velocity movements), the user pulls out the cable and then suddenly stops. Because of the inertia of the motor, the motor will continue to spin outwards (in a direction corresponding to the cable being pulled out, where the inertia is overcoming the torque of the motor that is being applied in a direction corresponding to reeling in of the cable—that is, the inertia is causing the motor to turn in a direction that is different from the direction that the motor is pulling). Because the user is no longer pulling on the cable (and the end of the cable that the user is holding onto is no longer moving), there will be no tension on the cable momentarily. This will result in the cable becoming slack (a slack event will occur). This slack event is detrimental for various reasons. For example, the slack event will cause extra cable to come off the motor, which may become tangled with other componentry of the system. The slack event may also cause an uncomfortable feel for the user. For example, the cable will have no tension for a period of time, but the rotation of the motor will transition to a point such that it is reeling the cable in, and there could be a sudden amount of tension of the cable, resulting in a potentially uncomfortable feeling of whiplash or jerk for the user.

As the motor is still being controlled to reel in the cable, and it was the user's force causing the cable to unspool (and the motor to turn outwards), with the user no longer pulling on the cable, the motor's requested torque (which is applied in the inward direction to spool up the cable) will counter the outward spinning due to inertia, and cause the motor's rotation to decelerate. In some embodiments, the system monitors for such deceleration, which will have a characteristic profile if it is due to a slack event. For example, the motor may decelerate in other situations, which would have different deceleration profiles.

The following are embodiments of detecting or inferring a deceleration profile that corresponds to a potential slack event. In some embodiments, the deceleration profile of the motor is determined based on the known inertia of the system and the amount of torque that is being requested from the motor.

As described above, in the example of a chop, when the user pulls and then stops, the motor will continue to spin outward (direction of unspooling) due to its inertia. In this scenario, because the user has stopped pulling, the rope will not be tight, and will continue to be let out, resulting in a potential slack event. Because there is still torque being requested from the motor in the inward direction (direction of spooling), the motor will begin to decelerate. Based on the known inertia of the motor and the requested torque, the profile of the deceleration is determined.

For example, the system monitors for motor deceleration. However, as described above, deceleration of the motor may occur for various reasons. For example, the deceleration may be due to a lack of tension on the line (because of an exercise such as the chop described above, which would lead to a slack event), or it may be due to the person slowing down (e.g., transitioning from the concentric to eccentric phase of a repetition). The deceleration profiles for these two scenarios will be different. The lack of tension on the line will cause a slack event, and in order to detect the occurrence of a slack event (in order to compensate for it), in some embodiments the system monitors for a type of deceleration that corresponds a lack of tension on the cable. For example, the system detects a deceleration of the motor. The inertia of the motor and the amount of applied torque are determined. Based on the inertia of the motor and the applied torque, it is then determined whether the observed deceleration is due to a lack of tension, or for some other reason, such as due to transitioning between the concentric phase and the eccentric phase. If it is determined that the observed deceleration is indicative of a lack of tension (and thus, a slack event), torque compensation is triggered in response.

In response to detecting that the profile of the deceleration corresponds to a potential slack event, the system is configured to compensate for the slack event by injecting additional torque to reel the cable in and prevent slack from generating. For example, the motor is instructed to increase its torque (in the direction to reel or pull in the cable onto the motor). That is, torque is being applied in the opposite direction to how the motor is rotating due to inertia (which when the user stops pulling, the motor is still rotating outwards in the direction of unspooling due to that inertia).

As described above, in some embodiments, the system detects a slack event based on the profile of the deceleration of the motor. For example, when a user suddenly stops pulling on the rope, which will cause a slack event to occur, this will cause the motor to decelerate in a manner with a certain set of characteristics. That is, the profile of the deceleration is determined to indicate whether the cable is being manipulated in a manner that is likely to result in a slack event. Other deceleration profiles for other types of cable manipulations that result in slack events may also be monitored for. That is, if a user performs a movement that results in a sudden stopping of pulling on the rope, which causes a lack of tension on the cable, this may result in a slack event. The sudden cessation of pulling on the rope will result in a distinctive signature or pattern or amount of observed deceleration of the motor. The system detects whether sudden cessation of pulling on the rope has occurred by detecting whether a corresponding deceleration profile has occurred.

As described above, the motor is evaluated. It is determined that the motor is spinning in the opposite direction to the torque that is being applied. The motor will decelerate as that applied torque overcomes inertia (e.g., motor rotation will change direction and rewind or reel the cable in). Deceleration of the motor is detected. When a person lets go, the crossover velocity (where the angular velocity changes sign) is determined, including the deceleration. This deceleration profile is different from the profile of the deceleration that would occur if a user is switching from a concentric to eccentric phase, where they are extending the cable, and after being at the top of the motion, the cable is returned inwards (so that it is being retracted into the arm). In this case, the deceleration profile will be different because in the case of a user going from the top of the rep and back down, there will still be a force acting on the motor opposing the torque (e.g., user is pulling out, but then letting cable in, in which case a slack event is unlikely, as there is still tension on the cable), versus in the case of the user suddenly letting go, there will suddenly be no user force acting on the motor opposing the torque, which results in a sudden absence of tension on the cable (and leading to potential slack events as the cable would continue to unspool). If the deceleration profile corresponding to sudden loss of cable tension (because the end of the cable that the user is holding suddenly stops moving) is determined (based on the known inertia of the motor and the known amount of torque that the motor is being requested to provide), then it is detected that a slack event may occur and should be compensated for.

In some embodiments, the amount of torque that is injected to compensate for slack events is tunable. For example, the amount or magnitude of torque and/or the duration or length of application of the torque is adjustable. For example, the compensation can be applied quickly, resulting in an abrupt sensation. The compensation may also be applied in a more gradual manner by adjusting the application of compensation torque. That is, the torque compensation is tunable for feel or stiffness.

As described above, detection of a slack event is determined by detecting a motor deceleration profile. The slack event is compensated for by applying a compensating amount of torque. The torque compensation is tunable to provide different feel, by adjusting the magnitude and duration of the torque compensation.

For example, the stiffness of the system can be adjusted so that the cable does not suddenly go from having no tension to having tension (when the motor decelerates beyond the point where it is now rotating in the direction that causes the cable to reel in). For example, consider a wight stack. Suppose that the user suddenly pulls on a cable attached to the weight stack, causing the weight stack to suddenly rise up. As part of performing the explosive movement, the user stops pulling abruptly. The weight stack would become weightless (and the cable would have no tension). The weight stack, due to gravity, would then start returning to the ground, where at some point the cable will suddenly go from having no tension to having tension. This would cause the user to feel a jerking sensation. While this could not be controlled in a typical weight stack, in the dual motor system described herein, the torque compensation may be applied (based on adjusting magnitude and duration) such that such jerking is reduced or minimized or otherwise controlled.

Motor Calibration

The following are embodiments of motor calibration. In some embodiments, an end of line test is implemented after the motor is built that measures various constants such as resistance, inductance, its Kt and Kv values, torque, back EMF values for rotational speed, etc. to confirm that there are no manufacturing defects and is performing as expected.

A secondary test may also be run on the motor, which tests and calibrates the encoder against the Hall sensors that are in the motor to obtain accurate rotational position. This calibration includes an error offset correction of the encoder to obtain an accurate position (as there may be variation in how encoders are assembled across different motors).

In some embodiments, the calibration values are stored in the EEPROM of the encoder board on the motor. The EEPROM provides a unique storage place for data that can be queried, and that follows the motors throughout their life. They may also be stored in other components of the system.

Examples of calibration values stored include hardware information about the motor. This includes Hall sensor error angles, computed as described above. In other embodiments, the calibration values stored include individual Kt values. In other embodiments, a general map of calibration values is applied to all motors. As another example, a torque ripple variability map is stored in the EEPROM. For example, as described above, in some embodiments, to reduce torque ripple, a torque sensor is installed inline, which may then be used to measure and apply torque versus rotational angle back to the motor to reduce torque perturbation (e.g., the force impulse that user feels as they pull out a cable slowly). In some embodiments, as part of performing calibration, the torque as a function of rotational angle is measured to determine the torque ripple variability map as described above.

Calibration of Delivered Digital Resistance Provided by the Dual Motors

The following are embodiments of calibration of the motors so that the two motors provide the same or equal tension for the same requested amount of weight. For example, while users may have difficulty in determining absolute weight values, they are better able to distinguish between relative weight values. Using embodiments of the calibration techniques described herein ensures that one arm does not provide more actual weight than the other arm for the same amount of requested weight.

The following are embodiments of calibrating the motors of the dual motor exercise machine so that given a same requested amount of torque sent to both motors, the resistance provided by the motors is the same. In some embodiments, this calibration is performed in the field.

As one example, a bag lift calibration is performed. For example, one motor lifts a bag (or other known weight or load). The other motor lifts the same bag. The amount of current used by the two motors is determined. A difference in the amount of current is determined, which informs the system how much current to apply to the motors (which may be different for each motor) to achieve a certain amount of torque for each arm. In some embodiments, the current is also measured as a function of speed. As another example, in some embodiments, keeping the two motors calibrated over time includes user interaction, such as prompting a user to hook the two cables together and then configuring the digital strength trainer to run a self-calibration test.

Based on the measurements determined for the motors based on the calibration testing, calibration parameters are set for the motors. For example, each motor has an adjustable torque constant value Kt. The torque constant for each motor is adjusted according to the calibration test. The Kt value for a motor may also be adjusted based on other parameters. For example, in some embodiments, when the machine is fully assembled, an end of line test is performed to test the tension accuracy between the two motors. The Kt value may be adjusted based on the results of the end of line test. As another example, an estimate of the friction of the system is determined. A friction coefficient modifier is adjusted or tuned up and down. If the cable is pulled inwards and the cable is let outwards, there will be friction applied in two different directions. How much friction there is in the two different directions, and how much torque is necessary to overcome it, is determined. The Kt value for a motor may then be adjusted or tuned accordingly. The calibration described herein allows the digital strength trainer to achieve the same feel on both arms.

Dynamic Adjustability of System Feel

In some embodiments, the feel of the system is dynamically adjusted, for example to feel different at different weights. For example, the system can have one feel at high weights, and another feel at lower weights. As one example of dynamically adjusting feel, inertia can be added by adding more torque to the system at high weight situations so that users who would like to lift heavier weights have a better workout, while still allowing the low weight experience that is similar to a nominal hardware system.

For example, the amount of torque that is requested from the motor can be based on the acceleration of the motor, according to the example equation tau=I*alpha, where "I" is the moment of inertia, and alpha is the angular acceleration. To make the system feel as if it has a large inertial event, increasing the amount of torque for the same amount of alpha is equivalent to having a larger I (inertial) term.

As one example, suppose that the user requests 70 pounds of weight (e.g., via a user interface). The system performs a lookup of a lookup table that indicates, for a given resistance, a corresponding value of inertial feel. When the user, as part of performing exercise, accelerates in a manner that approaches the angular acceleration (alpha) corresponding to the inertial feel, more weight is added so that the acceleration occurs in a same way as a physical object with the additional inertia. That is, the system can provide an adjustable inertial feel that can be tuned up or down by adjusting the amount of torque. This change or adjustment in inertial feel can be adjusted through firmware.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A strength training machine, comprising:

a first motor oriented at a first angle relative to a chassis;

a first cable coupled to the first motor;

a second motor oriented at a second angle relative to the chassis, wherein the first and second angles skew the motors with respect to each other;

a second cable coupled to the second motor; and a processor configured to:

receive a first position of the first cable;

receive a second position of the second cable;

aggregate the first position and the second position to obtain an aggregate position value; and perform, using the aggregate position value, a repetition detection technique to determine whether an exercise repetition has occurred, comprising to:

update a start point and an end point associated with each exercise repetition; and extract range of motion and repetitions from a series of aggregated position updates, wherein the range of motion relates to the start point and the end point.

2. The strength training machine of claim 1, wherein the first and second angles are determined based at least in part on a range of desired fleet angles.

3. The strength training machine of claim 1, further comprising:

a first pulley, wherein the first cable is guided through the first pulley, and wherein the first pulley is angled relative to the chassis.

4. The strength training machine of claim 1, wherein the first motor and the second motor are arranged in a staggered orientation.

5. The strength training machine of claim 1, wherein the first motor and the second motor comprise direct drive motors.

6. The strength training machine of claim 1, wherein the machine is configured for a user to perform a first exercise involving the first motor, wherein the user performs a second exercise movement involving the second motor, and wherein the first motor and the second motor are driven with different amounts of torque.

7. The strength training machine of claim 1, wherein torque of at least one of the first motor or the second motor is adjusted based at least in part on a determination that a user of the strength training machine should be spotted based on sensor measurements based on sensor measure measurements with respect to the first motor.

8. The strength training machine of claim 7, wherein torque of the first motor is adjusted.

9. The strength training machine of claim 7, wherein both torque of the first motor and torque of the second motor are adjusted together.

10. The strength training machine of claim 1, wherein the processor is configured to throttle power to the first motor.

11. The strength training machine of claim 10, wherein the processor is configured to throttle power to the first motor based at least in part on a characteristic of an exercise movement being performed.

12. The strength training machine of claim 11, wherein the characteristic of the exercise movement being performed comprises the processor is configured to provide an indication of whether the exercise movement being performed involves the use of one or both motors.

13. The strength training machine of claim 10, wherein the processor is configured to throttle power to the first motor based at least in part on a determined power consumption of the first motor.

14. The strength training machine of claim 13 wherein the power consumption of the first motor is determined at least in part by determining:

a mechanical power provided by the first motor; and a power loss of the first motor.

15. The strength training machine of claim 14, wherein the power loss of the first motor is determined at least in part by dynamically determining a resistance of the first motor based at least in part on a measured temperature.

16. The strength training machine of claim 1, wherein the first motor and the second motor are calibrated to provide a substantially similar tension on the first cable and the second cable, respectively, given a same requested weight.

* * * * *